US009298134B2

(12) United States Patent
Okubo et al.

(10) Patent No.: US 9,298,134 B2
(45) Date of Patent: Mar. 29, 2016

(54) TONER SUPPLY APPARATUS AND TONER CARTIDGE

(71) Applicant: Samsung Electronics Co., Ltd., Suwon-si (KR)

(72) Inventors: Yuriko Okubo, Yokohama (JP); Hirokazu Murase, Yokohama (JP)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/558,026

(22) Filed: Dec. 2, 2014

(65) Prior Publication Data

US 2015/0153682 A1 Jun. 4, 2015

(30) Foreign Application Priority Data

Dec. 3, 2013 (JP) ..... 2013-250299
Sep. 3, 2014 (JP) ..... 2014-179502
Nov. 6, 2014 (KR) ..... 10-2014-0153750

(51) Int. Cl.
*G03G 15/08* (2006.01)

(52) U.S. Cl.
CPC ..... *G03G 15/0886* (2013.01)

(58) Field of Classification Search
CPC ..... G03G 15/0865; G03G 15/0866
USPC ..... 399/258
See application file for complete search history.

(56) References Cited

U.S. PATENT DOCUMENTS 4,729,189 A * 3/1988 Whitcomb ..... 47/39
7,792,438 B2 * 9/2010 Sato ..... G03G 15/0839 399/12
8,335,455 B2 12/2012 Maeshima (Continued)

FOREIGN PATENT DOCUMENTS

EP 1184742 3/2002
JP 06-222664 8/1994

(Continued)

OTHER PUBLICATIONS

European Communication dated May 26, 2015 in European Application No. 14195945.2.
Extended European Search Report dated May 6, 2015 in European Application No. 14195945.2.

*Primary Examiner* — Walter L Lindsay, Jr.
*Assistant Examiner* — Frederick Wenderoth
(74) *Attorney, Agent, or Firm* — Staas & Halsey LLP

(57) ABSTRACT

The present disclosure relates to securely close a discharge port of a toner cartridge by a shutter. The shutter to close the discharge port is provided with shutter-side coupling portions. A toner cartridge holding member is provided with holding member-side coupling portions which are coupled with the shutter-side coupling portions and close the discharge port by sliding the shutter according to movement of a toner accommodating portion, holding coupling portions to restrict movement of the toner cartridge in a direction in which coupling of the holding member-side coupling portions is released, and holding member-side inducing portions which induces the toner cartridge in a direction in which coupling with the shutter-side coupling portions is released after the discharge port is closed. The toner cartridge is provided with cartridge-side guide portions to restrict the movement of the shutter in a direction in which the coupling of the shutter-side coupling portions is released until the discharge port is closed.

18 Claims, 32 Drawing Sheets

(56) References Cited

U.S. PATENT DOCUMENTS

| | | | | |
|---|---|---|---|---|
| 8,655,234 | B2 | 2/2014 | Hori et al. | |
| 2005/0028180 | A1* | 2/2005 | Hertrich | 720/633 |
| 2005/0123323 | A1 | 6/2005 | Koyama et al. | |
| 2009/0232547 | A1 | 9/2009 | Nagae et al. | |
| 2010/0129118 | A1* | 5/2010 | Kimura et al. | 399/260 |
| 2012/0114387 | A1* | 5/2012 | Horii et al. | 399/258 |
| 2012/0222776 | A1 | 9/2012 | Sakamoto et al. | |
| 2012/0257912 | A1 | 10/2012 | Hasebe | |

FOREIGN PATENT DOCUMENTS

| | | |
|---|---|---|
| JP | 2002-72651 | 3/2002 |
| JP | 2002-139903 | 5/2002 |
| JP | 2005-134452 | 5/2005 |
| JP | 2006-309147 | 11/2006 |
| JP | 2010-170100 | 8/2010 |
| JP | 2011-191618 | 9/2011 |
| JP | 2012-37752 | 2/2012 |

* cited by examiner

TONER SUPPLY APPARATUS AND TONER CARTIDGE

CROSS-REFERENCE TO RELATED APPLICATIONS

This application claims priority benefits from Japanese Patent Applications No. 2013-250299 filed Dec. 3, 2013 and No. 2014-179502 filed Sep. 3, 2014 in the Japanese Patent Office and from Korean Patent Application No. 10-2014-0153750 filed Nov. 6, 2014 in the Korean Intellectual Property Office, the disclosures of which are incorporated herein by reference in their entirety.

BACKGROUND

1. Field

Embodiments relate to a toner supply apparatus and a toner cartridge disposed in the toner supply apparatus.

2. Description of the Related Art

In the conventional electro photographic technology, a toner cartridge in which toner is accommodated is mounted to a toner cartridge holding member of an image forming apparatus so as to supply the toner.

The toner cartridge has a shutter that closes a toner discharge port of the toner cartridge when the toner cartridge is removed. Thus, when removing the toner cartridge, toner remaining in the toner cartridge is prevented from being discharged through the toner discharge port. One example of the toner cartridge equipped with the shutter is disclosed in Japanese Patent Publication No. H6-222664.

Such a toner cartridge provided with a shutter has been required to reliably close a toner discharge port by a simple configuration. For example, in a toner cartridge disclosed in the Japanese Patent Publication No. H6-222664, a shutter is slid to a closed position by an elastic force of a spring. However, it's configuration is complex, and to surely slide the shutter is considered to be impossible due to variation in the elastic force of the spring, etc.

SUMMARY

In an aspect of one or more embodiments, there is provided a toner supply apparatus and a toner cartridge capable of reliably closing a discharge port of the toner cartridge by a shutter.

In an aspect of one or more embodiments, there is provided a toner supply apparatus which includes a toner cartridge having a toner accommodating portion and a shutter to close a discharge port of toner disposed in the toner accommodating portion and a toner cartridge holding member from which the toner cartridge is separated by sliding the toner cartridge. The shutter may include shutter-side coupling portions projecting toward the toner cartridge holding member. The toner cartridge holding member may include holding member-side coupling portions, a toner cartridge position restricting portion, and an inducing portion. The holding member-side coupling portions may allow the shutter to slide with respect to the toner accommodating portion to close the discharge port by being coupled with the shutter-side coupling portions when the toner accommodating portion is slid in a separating direction of the toner cartridge. T toner cartridge position restricting portion may restrict movement of the toner cartridge in a direction in which coupling between the shutter-side coupling portions and the holding member-side coupling portions is released in a sliding position of the toner accommodating portion until the toner accommodating portion is slid in the separating direction of the toner cartridge so that the discharge port is closed by the shutter. The inducing portion may induce the toner cartridge in a direction in which the coupling between the shutter-side coupling portions and the holding member-side coupling portions is released in a sliding position of the toner accommodating portion after the toner accommodating portion is slid in the separating direction of the toner cartridge so that the discharge port is closed by the shutter. The toner accommodating portion may include a shutter position restricting portion to restrict movement of the shutter in a direction in which the coupling between the shutter-side coupling portions and the holding member-side coupling portions is released in the sliding position of the toner accommodating portion until the toner accommodating portion is slid in the separating direction of the toner cartridge so that the discharge port is closed by the shutter.

In the toner supply apparatus, the shutter may close the discharge port by the sliding operation for separating the toner cartridge. Therefore, the discharge port may be reliably closed by the shutter in a simple structure in which the other mechanism for sliding the shutter is not installed. After the discharge port is closed by the shutter, the toner cartridge is induced in the direction in which the coupling between the shutter-side coupling portions and the holding member-side coupling portions is released. Thus, by the sliding operation for separating the toner cartridge, the coupling between the shutter-side coupling portions and the holding member-side coupling portions may be released by a simple configuration. Until the discharge port is closed by the shutter, the shutter position restricting portion restricts the movement of the shutter. Furthermore, the toner cartridge position restricting portion restricts the movement of the toner cartridge in a direction in which the coupling between the shutter-side coupling portions and the holding member-side coupling portions is released. Thereby, the shutter-side coupling portions may be securely coupled with the holding member-side coupling portions, and the shutter may be reliably slid to the closing position of the discharge port.

A coupled height a of the shutter-side coupling portion and the holding member-side coupling portion and an induced height b to which the inducing portion induces the toner cartridge may satisfy a relationship of $a \leq b$. By setting sizes of the parts to satisfy the relationship, when the toner cartridge is induced by the inducing portion, the shutter-side coupling portions may be easy to climb over the holding member-side coupling portions. Therefore, it is possible to facilitate the sliding operation for separating the toner cartridge.

The shutter is configured to be moved with respect to the toner accommodating portion from a closed position of the discharge port in a direction in which the coupling between the shutter-side coupling portions and the holding member-side coupling portions is released. In this case, since the toner cartridge moves in the direction in which the coupling between the shutter-side coupling portions and the holding member-side coupling portions is released with respect to the toner cartridge, the coupling between the shutter-side coupling portions and the holding member-side coupling portions may be released by the movement of the shutter and a movement of the toner cartridge by the inducing portion. In other words, it is possible to reduce a moving width of the toner cartridge in the direction in which the coupling between the shutter-side coupling portions and the holding member-side coupling portions is released compared to a case in which the coupling between the shutter-side coupling portions and the holding member-side coupling portions is released by only movement of the toner cartridge by the inducing portion. In this way, since the moving width of the toner cartridge for releasing the coupling between the shutter-side coupling portions and the holding member-side coupling portions can be reduced, the miniaturization of the toner supply apparatus may be possible.

A coupled height a of the shutter-side coupling portion and the holding member-side coupling portion, an induced height b to which the inducing portion induces the toner cartridge, and a moving height c by which the shutter are configured to move in the closed position of the discharge port may satisfy a relationship of $a-b \leq c$, where $c \neq 0$. By setting the individual parts so as to satisfy the relationship, it is possible to reliably release the coupling between the shutter-side coupling portions and the holding member-side coupling portions while the discharge port is being closed by the shutter.

A main body portion of the toner cartridge holding member may include a toner supply port which is in communication with the discharge port when the toner accommodating portion is placed in a toner supply position. The toner supply position may be where the toner cartridge is mounted to the toner cartridge holding member, and toner is supplied from the toner accommodating portion toward the toner cartridge holding member. The toner cartridge holding member may include a holding member-side seal member and a holding member-side shutter. The holding member-side seal member may surround a periphery of the toner supply port, and seal a gap between the toner accommodating portion and the main body portion of the toner cartridge holding member when the toner accommodating portion is placed in the toner supply position. The holding member-side shutter may close the toner supply port by allowing the holding member-side seal member to be interposed between the main body portion of the toner cartridge holding member and the toner supply port when the discharge port is not in communication with the toner supply port. The holding member-side seal member may be formed of an elastic material. A thickness d of the holding member-side seal member when the toner accommodating portion is located at the toner supply position and a thickness e of the holding member-side seal member when the discharge port is not in communication with the toner supply port and the holding member-side seal member is interposed therebetween by the holding member-side shutter may satisfy a relationship of $d \leq e$.

When the discharge port is not in communication with the toner supply port and the holding member-side seal member is interposed therebetween by the holding member-side shutter, the thickness of the holding member-side seal member is thicker than when the discharge port is in communication with the toner supply port. In other words, when the toner supply port is closed by sliding the holding member-side shutter on the top surface of the holding member-side seal member, a height of the top surface of the holding member-side seal member is higher than when the discharge port is in communication with the toner supply port (when $d=e$, they are in the same level). Here, when the discharge port is not in communication with the toner supply port, the supply of toner is stopped. Accordingly, when the discharge port is not in communication with the toner supply port, the height of the top surface of the holding member-side seal member is higher than the height of a top surface of the toner which faces the toner supply port (when $d=e$, they are in the same level). Since the holding member-side shutter is slid on the top surface of the holding member-side seal member which is at a position higher than or the same height as the top surface of the toner which faces the toner supply port, the holding member-side shutter may be prevented from scratching the toner facing the toner supply port. Accordingly, toner may be prevented from being scattered through the toner supply port, and the inside of the toner supply apparatus may be prevented from being contaminated by the toner.

The toner cartridge may include a cartridge-side seal member which surrounds the periphery of the discharge port and is formed of an elastic material. The toner cartridge holding member may include a pulling portion which induces the toner accommodating portion to approach toward the main body portion of the toner cartridge holding member. The pulling portion may induce the toner accommodating portion to approach toward the main body portion of the toner cartridge holding member than when the toner cartridge seal member and the holding member-side seal member are not overlapped, in a sliding position of the toner accommodating portion from when the cartridge seal member and the holding member-side seal member are overlapped to the toner supply position, when viewing in a direction of an axial line of the discharge port, while the toner accommodating portion is slid in a mounting direction opposite to the separating direction of the toner cartridge.

Since the toner accommodating portion is induced by the pulling portion, degree of closeness of the cartridge-side seal member and the holding member-side seal member is increased, and toner leaking may be reliably prevented. Also, when viewing along the direction of the axial line of the discharge port, after the cartridge-side seal member and the holding member-side seal member are overlapped; the cartridge-side seal member is brought into close contact with the holding member-side seal member by the pulling portion. Thereby, when sliding the toner accommodating portion, it may be prevented that the end of the cartridge-side seal member and the end of the holding member-side seal member is caught in each other. Accordingly, damage of the end of the cartridge-side seal member and the end of the holding member-side seal member may be prevented.

The cartridge seal member may surround a periphery of the discharge port and seal a gap between the toner accommodating portion and the shutter when the discharge port is closed by the shutter. The shutter may include slide coupling portions. The slide coupling portions may be coupled with the toner accommodating portion in a sliding position of the toner accommodating portion when the toner accommodating portion is slid in the separating direction of the toner cartridge so that the coupling between the shutter-side coupling portions and the holding member-side coupling portions is released. The sliding position of the toner accommodating portion when the coupling between the shutter-side coupling portions and the holding member-side coupling portions is released is referred to as a first sliding position. A direction which is perpendicular to the separating direction of the toner cartridge and at the same time perpendicular to the direction of the axial line of the discharge port is referred to as a first direction. When the toner accommodating portion is placed at the first sliding position, the discharge port, when viewing in the first direction, may be placed between one end and the other end of the slide coupling portions along the separating direction of the toner cartridge.

By sliding the toner accommodating portion in the separating direction, the discharge port may be closed by the shutter. After the discharge port is closed, the coupling between the shutter-side coupling portions and the holding member-side coupling portions is released by the shutter-side coupling portions climbing up the holding member-side coupling portions. When the shutter-side coupling portions climb over the holding member-side coupling portions, a point where the shutter-side coupling portions and the holding member-side coupling portions are coupled with each other acts as a force point. Thereby, the shutter is pushed toward the toner accommodating portion to press the cartridge-side seal member. Also, when the shutter-side coupling portions climb over the holding member-side coupling portions, one, which is located on the far side from the force point, of the opposite ends of the slide coupling portion acts as a fulcrum. In other words, when viewing in the first direction, the shutter is rotated about the fulcrum so that the end of the shutter, in which the shutter-side coupling portions are coupled with the holding member-side coupling portions, approaches toward the toner accommodating portion. Also, the discharge port, when viewing in the first direction, is placed between the one end and the other end of the slide coupling portion. In other words, when the shutter is rotated, the fulcrum is, when viewing in the first direction, located at the outside of the discharge port. Thereby, when the shutter is rotated around the fulcrum so that the cartridge-side seal member is pressed, excessive deformation of the cartridge-side seal member may be prevented. Also, in the peripheral edge of the discharge port, the cartridge-side seal member may be uniformly pressed by the shutter. Accordingly, the toner leaking may be prevented.

The toner cartridge may include a cartridge-side seal member which surrounds the periphery of the discharge port and seals a gap between the toner accommodating portion and the shutter when the discharge port is closed by the shutter. The cartridge-side seal member may be formed of an elastic material. The shutter may include slide coupling portions. The slide coupling portions may be coupled with the toner accommodating portion in a sliding position of the toner accommodating portion when the toner accommodating portion is slid in the separating direction of the toner cartridge so that the coupling between the shutter-side coupling portions and the holding member-side coupling portions is released. The sliding position of the toner accommodating portion when the coupling between the shutter-side coupling portions and the holding member-side coupling portions is released is referred to as a first sliding position. A direction which is perpendicular to the separating direction of the toner cartridge and at the same time perpendicular to the distance of the axial line of the discharge port is referred to as a first direction. When the toner accommodating portion is placed at the first sliding position, the discharge port, when viewing in the first direction, may be placed between one end and the other end of the slide coupling portion along the separating direction of the toner cartridge.

By sliding the toner accommodating portion in the separating direction, the discharge port may be closed by the shutter. After the discharge port is closed, the coupling between the shutter-side coupling portions and the holding member-side coupling portions is released by the shutter-side coupling portions climbing up the holding member-side coupling portions. When the shutter-side coupling portions climb over the holding member-side coupling portions, a point where the shutter-side coupling portions and the holding member-side coupling portions are coupled with each other acts as a force point. Thereby, the shutter is pushed toward the toner accommodating portion to press the cartridge-side seal member. Also, when the shutter-side coupling portions climb over the holding member-side coupling portions, one, which is located on the far side from the force point, of the opposite ends of the slide coupling portion acts as a fulcrum. In other words, when viewing in the first direction, the shutter is rotated about the fulcrum so that the end of the shutter, in which the shutter-side coupling portions are coupled with the holding member-side coupling portions, approaches toward the toner accommodating portion. Also, the discharge port, when viewing in the first direction, is placed between the one end and the other end of the slide coupling portion. In other words, when the shutter is rotated, the fulcrum is, when viewing in the first direction, located at the outside of the discharge port. Thereby, when the cartridge-side seal member is pressed by the shutter, excessive deformation of the cartridge-side seal member may be prevented. Also, in the peripheral edge of the discharge port, the cartridge-side seal member may be uniformly pressed by the shutter. Accordingly, the toner leaking may be prevented.

The shutter may include action restricting portions to restrict the sliding operation of the shutter with respect to the toner accommodating portion in a position where the shutter closes the discharge port.

In a position where the shutter closes the discharge port, the sliding operation of the shutter is restricted. Accordingly, since the shutter may be prevented from being slid by an unexpected load in a position where the shutter closes the discharge port, toner leakage may be suppressed.

The toner cartridge holding member may include holding member-side coupling portions and restriction releasing portions. The holding member-side shutter coupling portions may be coupled with the shutter to slide the shutter with respect to the toner accommodating portion in a direction in which the discharge port is opened when the toner accommodating portion is slid in a mounting direction opposite to the separating direction of the toner cartridge. The restriction releasing portions may release the restriction of the sliding operation of the shutter by the action restricting portions when the toner cartridge is slid in the mounting direction so that the holding member-side shutter coupling portions are coupled with the shutter.

When the toner accommodating portion is slid in the mounting direction so that the holding member-side shutter coupling portions is coupled with the shutter, the restriction releasing portions release the restriction of the sliding operation of the shutter by the action restricting portions. In this way, only when the holding member-side shutter coupling portions is coupled with the shutter to open the discharge port, the restriction of the sliding operation of the shutter by the action restricting portions may be released. Accordingly, when unexpected, the toner may be prevented from leaking from the discharge port.

When the toner accommodating portion is slid in the separating direction of the toner cartridge so that the coupling between the shutter-side coupling portions and the holding member-side coupling portions is released, the restriction releasing portions may allow the action restricting portions to restrict the sliding operation of the shutter.

Thereby, when the toner cartridge is slid in the separating direction so that the coupling between the shutter-side coupling portions and the holding member-side coupling portions is released, the sliding operation of the shutter with respect to the toner accommodating portion is restricted by the action restricting portions. In this way, when separating the toner cartridge, after the discharge port is closed by the shutter, the sliding operation of the shutter is restricted. Accordingly, it may not occur that the shutter is slid by an unexpected load so that the discharge port is opened. Thereby, the toner may be prevented from leaking from the discharge port.

The toner cartridge may include a slide guide extending along a sliding direction of the toner cartridge. The inducing portion may be slidably in contact with the slide guide when mounting and separating the toner cartridge. The slide guide may include a first guide portion and a second guide portion. The second guide portion may be located on a side of the separating direction of the toner cartridge than the first guide portion. The first guide portion may project toward the inducing portion than the second guide portion in a state where the toner cartridge is mounted to the toner cartridge holding member. The inducing portion may include a third guide portion and a fourth guide portion. The fourth guide portion may be located on a side of the separating direction of the toner cartridge than the third guide portion. The fourth guide portion may project toward the slide guide than the third guide portion in a state where the toner cartridge is mounted to the toner cartridge holding member. A height to which the inducing portion induces the toner cartridge and to which the fourth guide portion projects from the third guide portion is referred to as an induced height b. A height to which the first guide portion projects from the second guide portion is referred to as a protrusion height g. The induced height b and the protrusion height g may satisfy a relationship of $b \leq g$.

In the state in which the toner cartridge is mounted to the toner cartridge holding member, the first guide portion may be in contact with the third guide portion. Thereby, the position of the toner cartridge relative to the toner cartridge holding member may be defined. In this state, by satisfying the relationship of $b \leq g$, the second guide portion and the fourth guide portion may not interfere. Accordingly, in the state in which the toner cartridge is mounted to the toner cartridge holding member, it is possible to reliably define the position of the toner cartridge by the first guide portion and the third guide portion. Since the position of the toner cartridge is stable as described above, the toner may be prevented from leaking from the portion in which the toner accommodating portion and the toner cartridge holding member are in communication with each other.

The toner cartridge may include a cartridge-side seal member which surrounds the periphery of the discharge port and is formed of an elastic material. A main body portion of the toner cartridge holding member may be provided with a toner supply port. The toner supply port may be in communication with the discharge port when the toner cartridge is mounted to the toner cartridge holding member and the toner accommodating portion is placed in a toner supply position where the toner is supplied from the toner accommodating portion toward the toner cartridge holding member. The toner cartridge holding member may include a holding member-side seal member which surrounds a periphery of the toner supply port, and is formed of an elastic material, and a pulling portion. The pulling portion may induce the toner accommodating portion to approach toward the body portion of the toner cartridge holding member in a sliding position of the toner accommodating portion from when the cartridge seal member and the holding member-side seal member are overlapped to the toner supply position, when viewing in a direction of an axial line of the discharge port, while the toner accommodating portion is slid in a mounting direction opposite to the separating direction of the toner cartridge than when the toner cartridge seal member and the holding member-side seal member are not overlapped.

Since the toner accommodating portion is induced by the pulling portion, degree of closeness of the cartridge-side seal member and the holding member-side seal member is increased, and toner leaking may be reliably prevented. Also, when viewing along the direction of the axial line of the discharge port, after the cartridge-side seal member and the holding member-side seal member are overlapped; the cartridge-side seal member is brought into close contact with the holding member-side seal member by the pulling portion. Thereby, when sliding the toner accommodating portion, it may be prevented that the end of the cartridge-side seal member and the end of the holding member-side seal member is caught in each other. Accordingly, damage of the end of the cartridge-side seal member and the end of the holding member-side seal member may be prevented.

In an aspect of one or more embodiments, there is provided a toner cartridge which includes a toner accommodating portion and a shutter to close a discharge port of toner disposed in the toner accommodating portion, and is separated from a toner cartridge holding member by sliding. The shutter may include shutter-side coupling portions which are, when the toner accommodating portion is slid in a separating direction, coupled with holding member-side coupling portions of the toner cartridge holding member to slide the shutter with respect to the toner accommodating portion, thereby closing the discharge port. The toner accommodating portion may include a shutter position restricting portion which restricts movement of the shutter in a direction in which coupling between the shutter-side coupling portions and the holding member-side coupling portions is released in a sliding position of the toner accommodating portion until the toner accommodating portion is slid in the separating direction so that the discharge port is closed by the shutter.

In the toner cartridge, the shutter closes the discharge port by the sliding operation for separating the toner cartridge. Therefore, the discharge port may be reliably closed by the shutter in a simple structure in which the other mechanism for sliding the shutter is not installed. Until the discharge port is closed by the shutter, the shutter position restricting portion restricts the movement of the shutter. Thereby, the shutter-side coupling portions may be securely coupled with the holding member-side coupling portions, and the shutter may be reliably slid to the closing position of the discharge port.

The shutter may include an action restricting portion to restrict a sliding operation of the shutter with respect to the toner accommodating portion in a position where the shutter closes the discharge port.

In the position where the shutter closes the discharge port, the sliding operation of the shutter may be restricted by the action restricting portions. Thereby, since the shutter may be prevented from being slid by an unexpected load in the position where the shutter closes the discharge port, toner leakage may be suppressed.

According to the present disclosure, the discharge port of the toner cartridge may be securely closed by the shutter.

BRIEF DESCRIPTION OF THE DRAWINGS

These and/or other aspects and advantages of the present disclosure will become apparent and more readily appreciated from the following description of embodiments, taken in conjunction with the accompanying drawings of which.

DETAILED DESCRIPTION

Figure 1:
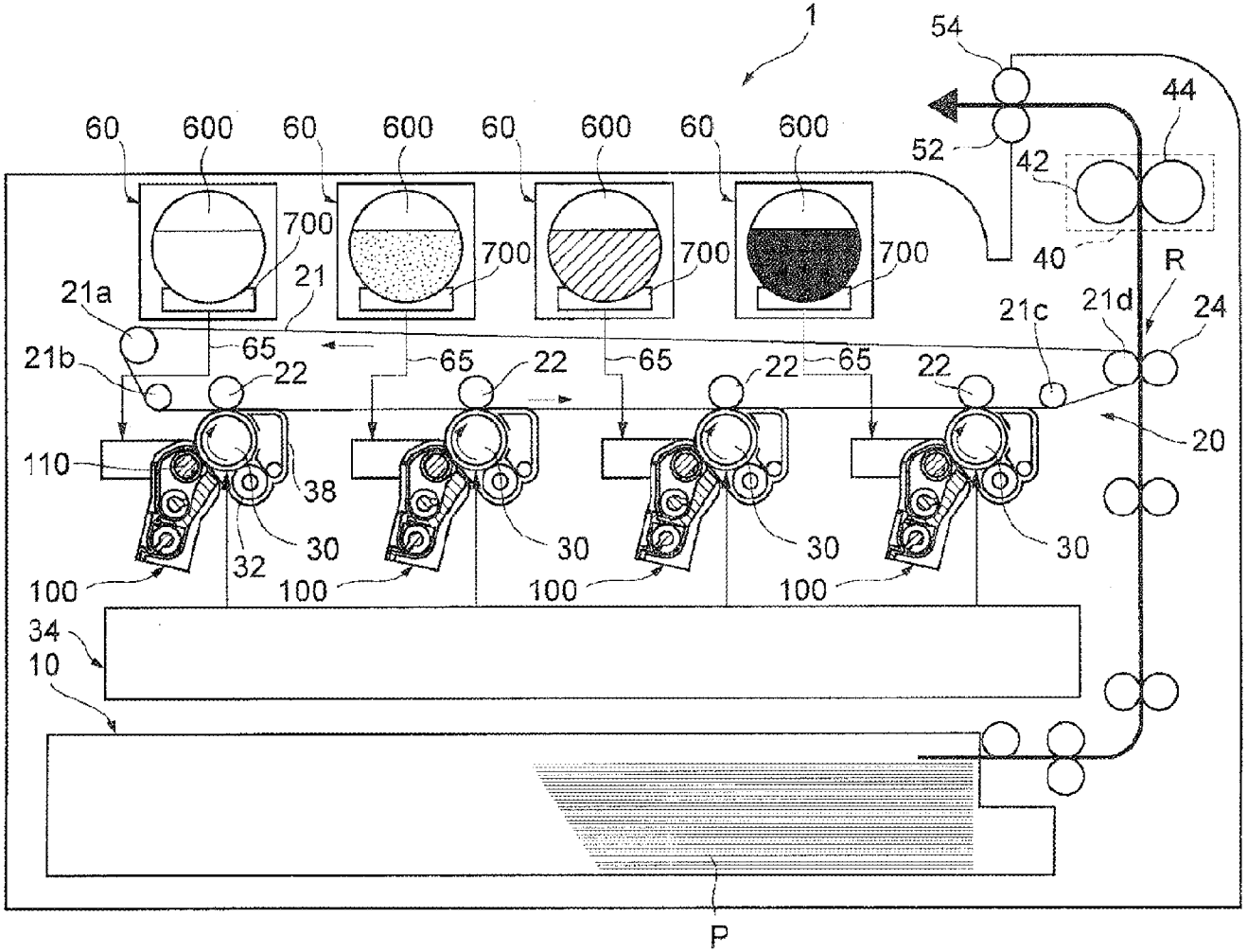
FIG. 1 is a view schematically illustrating a configuration of an image forming apparatus according to an embodiment.

Reference will now be made in detail to embodiments, examples of which are illustrated in the accompanying drawings, wherein like reference numerals refer to the like elements throughout. Embodiments are described below to explain by referring to the figures.

Hereinafter, an embodiment of an image forming apparatus to which a toner supply apparatus and a toner cartridge according to the present disclosure may be applied will be described with reference to the accompanying drawings. Further, in the description of figures, like elements are assigned the same reference numerals, and redundant description will be omitted.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

(Overall Configuration of an Image Forming Apparatus)

As illustrated in FIG. 1, an image forming apparatus 1 includes a recording medium conveying unit 10, a transfer unit 20, a photosensitive drum 30, four developing units (developing apparatuses) 100, and a fusing unit 40.

The recording medium conveying unit 10 accommodates sheets P, recording media on which an image is finally formed, and conveys the sheet P onto a recording medium conveying path. The sheets P are accommodated and stacked in a cassette. The recording medium conveying unit 10 allows the sheet P to reach a secondary transfer area R at timing when a toner image which will be transferred onto the sheet P reaches the secondary transfer area R.

The transfer unit 20 conveys the toner image formed by the developing units 100 to the secondary transfer area R where the toner image is secondarily transferred onto the sheet P. The transfer unit 20 includes a transfer belt 21, suspension rollers 21*a*, 21*b*, 21*c*, and 21*d* supporting the transfer belt 21, a primary transfer roller 22 sandwiching the transfer belt 21 with the photosensitive drum 30, and a secondary transfer roller 24 sandwiching the transfer belt 21 with the suspension roller 21*d*.

The transfer belt 21 is an endless belt which is moved on the circulation by the suspension rollers 21*a*, 21*b*, 21*c*, and 21*d*. The primary transfer roller 22 is disposed to press the photosensitive drum 30 from an inner circumferential surface of the transfer belt 21. On the other hand, the secondary transfer roller 24 is disposed to press the suspension roller 21*d* from an outer circumferential surface of the transfer belt 21. Also, the transfer unit 20 may include a belt cleaning apparatus to remove toner attached on the transfer belt 21.

The photosensitive drum 30 is an electrostatic latent image carrying member on an outer circumferential surface of which an image is formed, and, for example, may be an organic photoconductor (OPC). The image forming apparatus 1 according to the present embodiment is an apparatus capable of forming a color image, and, for example, has four photosensitive drums 30 corresponding to each of magenta, yellow, cyan, and black colors and disposed along a moving direction of the transfer belt 21. Around each of the photosensitive drums 30, as illustrated in FIG. 1, a charging roller 32, an exposure unit 34, the developing unit 100, and a cleaning unit 38 are disposed.

The charging roller 32 uniformly charges a surface of the photosensitive drum 30 to a predetermined potential. The exposure unit 34 exposes the surface of the photosensitive drum 30 charged by the charging roller 32 to correspond to an image to be formed on the sheet P. Thus, the potential of a portion of the photosensitive drum 30 which is exposed by the exposure unit 34 is changed so as to form an electrostatic latent image. A toner cartridge 600 of a toner supply apparatus 60 disposed to correspond to each of the four developing units 100 supplies each of the four developing units 100 with toner through a toner supply path 65. Each of the four toner cartridges 600 is filled with a supplement developer which is formed by mixing carrier and each of magenta, yellow, cyan, and black toners. The developing unit 100 generates a toner image by developing the electrostatic latent image formed on the photosensitive drum 30 with the toner supplied from the toner supply apparatus 60.

The cleaning unit 38 collects toner remaining on the photosensitive drum 30 after the toner image formed on the photosensitive drum 30 is primarily transferred onto the transfer belt 21. As the cleaning unit 38, for example, a configuration in which a cleaning blade being brought into contact with the outer circumferential surface of the photosensitive drum 30 removes the toner remaining on the photosensitive drum 30 may be employed. On the other hand, on the outer circumferential surface of the photosensitive drum 30, a discharging lamp to reset the potential of the photosensitive drum 30 may be disposed between the cleaning unit 38 and the charging roller 32 in a rotational direction of the photosensitive drum 30.

The fusing unit 40 allows the toner image which is secondarily transferred onto the sheet P from the transfer belt 21 to be attached and fused onto the sheet P. The fusing unit 40 includes, for example, a heat roller 42 and a pressure roller 44. The heat roller 42 is a cylindrical member rotatable about a rotational axis. A heating source, such as, for example, a halogen lamp, etc., is disposed inside the heat roller 42. The pressure roller 44 is a cylindrical member rotatable about a rotational axis, and is disposed to press the heat roller 42. A heat-resistant elastic layer, such as, for example, silicon rubber, etc., is disposed on the outer circumferential surface of each of the heat roller 42 and the pressure roller 44. The toner image is melted and fused onto the sheet P by passing the sheet P through a fusing nip which is a contacting region between the heat roller 42 and the pressure roller 44.

In addition, the image forming apparatus 1 is provided with discharging rollers 52 and 54 for discharging the sheet P onto which the toner image is fused by the fusing unit 40 outside the apparatus.

Next, operation of the image forming apparatus 1 will be explained. When an image signal of an image to be recorded is input to the image forming apparatus 1, a controller of the image forming apparatus 1 uniformly charges the surface of the photosensitive drum 30 by using the charging roller 32 based on the received image signal. Then, the controller forms an electrostatic latent image on the surface of the photosensitive drum 30 by irradiating a laser beam to the surface of the photosensitive drum 30 by the exposure unit 34.

On the other hand, in the developing unit 100, the toner and carrier are adjusted to be a desired mixing ratio, and are mixed and agitated so that the toner and carrier are uniformly dispersed to form developer with an optimal charge amount. The developer is carried onto the developing roller 110. Thus, when the developer is conveyed to a region facing the photosensitive drum 30 by rotation of the developing roller 110, the toner of the developer carried on the developing roller 110 is moved to the electrostatic latent image formed on the outer circumferential surface of the photosensitive drum 30 to develop the electrostatic latent image. The thus formed toner image is primarily transferred onto the transfer belt 21 from the photosensitive drum 30 in a region in which the photosensitive drum 30 faces the transfer belt 21. The toner images formed on the four photosensitive drums 30 are sequentially stacked onto the transfer belt 21, thereby forming a single stacked toner image. Then, the stacked toner image is secondarily transferred onto the sheet P conveyed from the recording medium conveying unit 10 in the secondary transfer area R in which the suspension roller 21*d* and the secondary transfer roller 24 face each other.

The sheet P onto which the stacked toner image is secondarily transferred is conveyed to the fusing unit 40. The stacked toner image is melted and fused onto the sheet P by passing the sheet P through between the heat roller 42 and the pressure roller 44 while applying heat and pressure. After that, the sheet P is discharged outside the image forming apparatus 1 by the discharging rollers 52 and 54. On the other hand, if the transfer belt 21 is provided with a belt cleaning apparatus, after the stacked toner image is secondarily transferred on to the sheet P, toner remaining on the transfer belt 21 may be removed by the belt cleaning apparatus.

(Configuration of a Toner Supply Apparatus)

As illustrated in FIG. 1, the toner supply apparatus 60 includes a toner cartridge 600 and a toner cartridge holding member 700. The toner cartridge holding member 700 detachably supports the toner cartridge 600. The toner cartridge 600 is, for example, removed from the toner cartridge holding member 700 when toner accommodated therein runs out, and then, a new toner cartridge 600 is attached to (or mounted to) the toner cartridge holding member 700. In this embodiment, the toner cartridge 600 is attached to or detached from the toner cartridge holding member 700 by sliding the toner cartridge 600 with respect to the toner cartridge holding member 700. The toner supply path 65 is connected to the toner cartridge holding member 700.

(Configuration of a Toner Cartridge)

Figure 2:
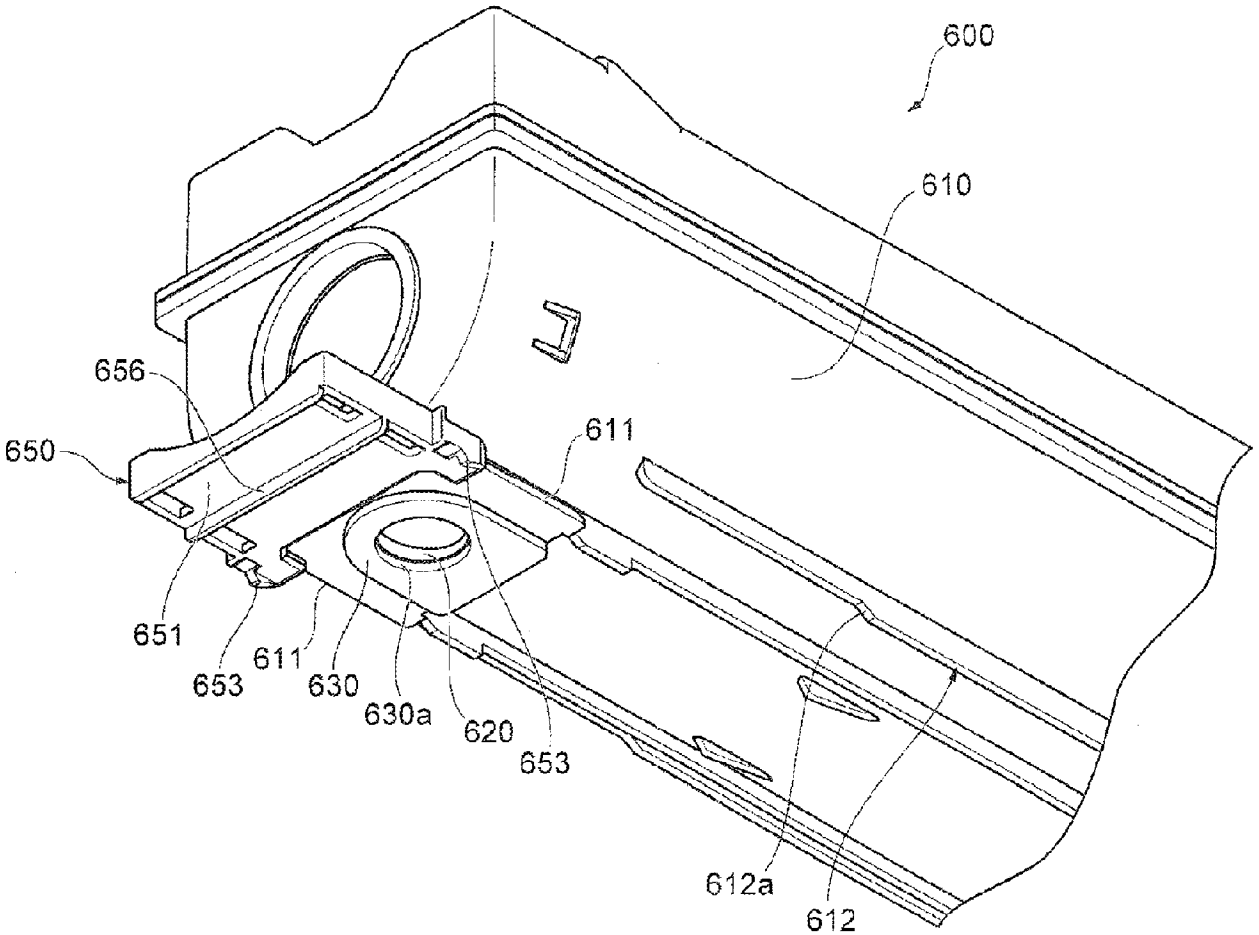
FIG. 2 is a perspective view illustrating a periphery of a discharge port disposed on a bottom surface of a toner cartridge in a state in which a shutter is slid so that the discharge port is exposed.

As illustrated in FIG. 2, the toner cartridge 600 includes a toner accommodating portion 610 and a shutter 650. The toner accommodating portion 610 is a vessel having a long barrel shape and has a space for accommodating toner thereinside. A discharge port 620 for discharging toner from the toner accommodating portion 610 is provided on a bottom surface of an end portion of the toner accommodating portion 610. A seal member 630 is disposed around the discharge port 620 on the bottom surface of the toner accommodating portion 610. The seal member 630 has an opening 630*a* which is provided at a position opposite to the discharge port 620. When the discharge port 620 is closed by the shutter 650, the seal member 630 fills up a gap between the toner accommodating portion 610 and the shutter 650. Also, the seal member 630 may be formed of an elastic material, such as urethane foam, etc.

A pair of cartridge-side guide portions (shutter position restricting portion) 611 extending in the lengthwise direction of the toner accommodating portion 610 is disposed around the discharge port 620 in the outer surface of the toner accommodating portion 610. The pair of cartridge-side guide portions 611 is disposed so that the discharge port 620 is located therebetween as viewing from the bottom surface of the toner accommodating portion 610, and projects toward a direction away from the discharge port 620. The cartridge-side guide portions 611 is extended from the end portion of the toner accommodating portion 610 in which the discharge port 620 is formed to a predetermined position beyond the discharge port 620.

Figure 3:
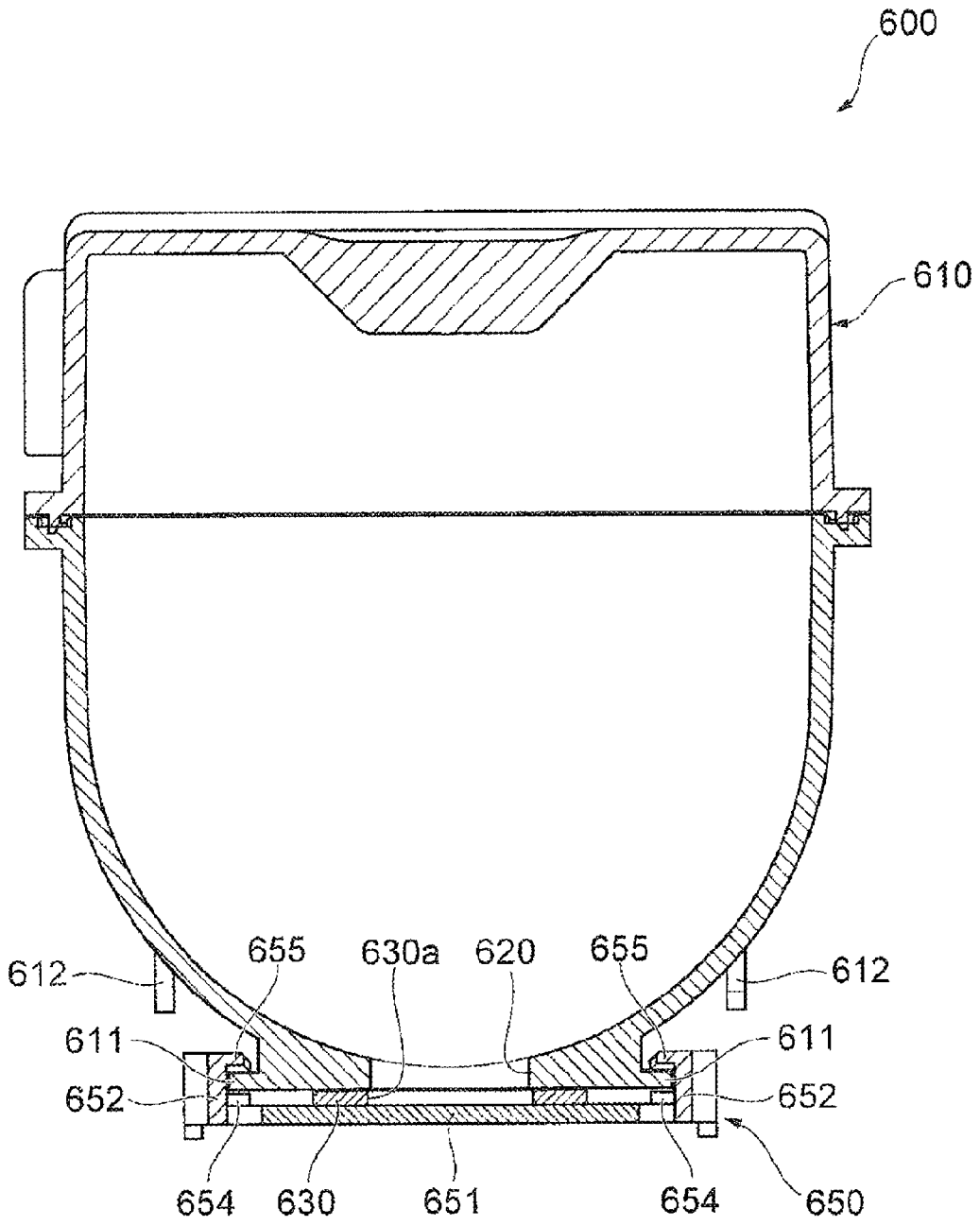
FIG. 3 is a cross-sectional view of a periphery of a discharge port disposed in a toner cartridge in a state in which the discharge port is closed by a shutter.

A pair of cartridge-side inducing portions 612 formed in a band shape is disposed in the bottom surface of the toner accommodating portion 610 (see FIGS. 2 and 3). The cartridge-side inducing portions 612 are extended in the lengthwise direction of the toner accommodating portion 610. The pair of cartridge-side inducing portions 612 is disposed so that the discharge port 620 is located between extension lines of the pair of cartridge-side inducing portions 612 as viewing the toner accommodating portion 610 from therebelow. The cartridge-side inducing portions 612 project downwardly from the bottom surface of the toner accommodating portion 610. A projecting height of the cartridge-side inducing portion 612 from the outer surface of the toner accommodating portion 610 is heightened from a portion of a way toward the other end portion from the end portion in which the discharge port 620 is disposed. On the other hand, the portion that varies in height of the cartridge-side inducing portion 612 is referred to as a step portion 612*a*. The step portion 612*a* is provided with an inclined surface. The position where the step portion 612*a* is disposed will be explained in detail later.

Figure 4A:
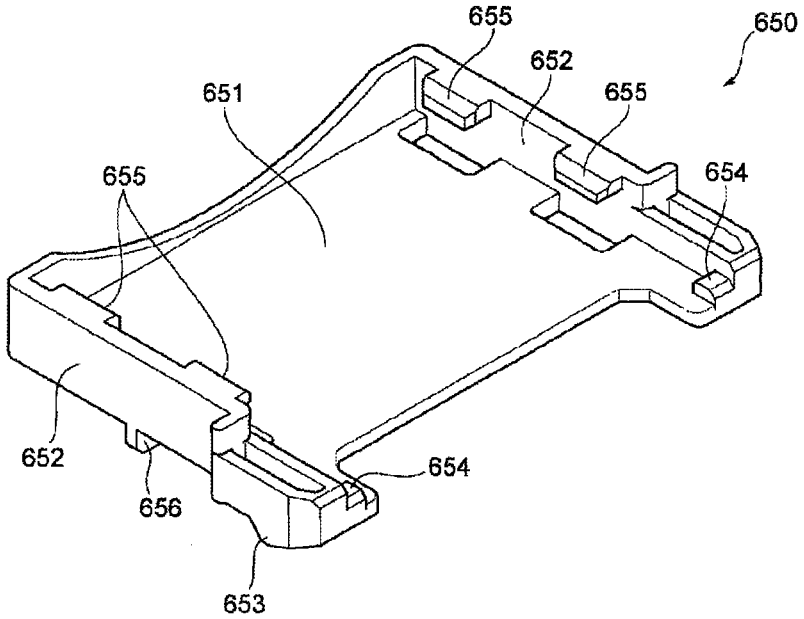
FIG. 4A is a perspective view illustrating a shutter.
Figure 4B:
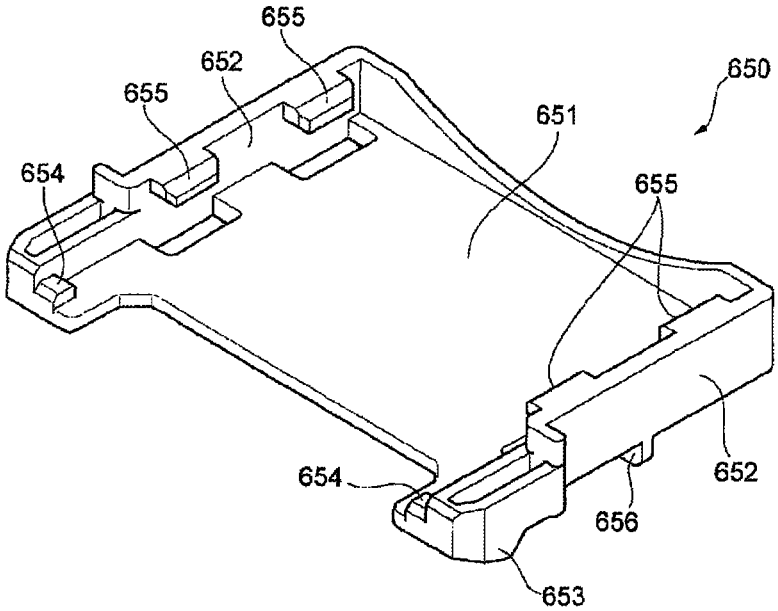
FIG. 4B is a perspective view illustrating the shutter viewing from another side thereof.

The shutter 650 is disposed in the toner accommodating portion 610 to slide along the cartridge-side guide portions 611. The discharge port 620 of the toner accommodating portion 610 can be closed by the shutter 650 by sliding the shutter 650. In detail, as illustrated in FIGS. 3, 4A, and 4B, the shutter 650 includes a shutter body 651, a pair of side-walls 652, a pair of shutter-side coupling portions 653, a pair of shutter-side protrusions 654, a plurality of slide coupling portions 655, and a bottom-side projection 656.

The shutter body 651 is formed in a flat plate shape. When the shutter 650 is slid at a position where the shutter 650 closes the discharge port 620 of the toner accommodating portion 610, the shutter body 651 covers and closes the discharge port 620. The pair of side-walls 652 is formed perpendicularly in edges of the shutter body 651 opposite to each other, respectively. An interval between the pair of side-walls 652 is determined as a length so that the pair of cartridge-side guide portions 611 can be inserted therebetween (see FIG. 3).

Each of the plurality of slide coupling portions 655 projects toward the inner side from a top end of each of the pair of side-walls 652. The shutter 650 is inserted into the toner accommodating portion 610 so that the cartridge-side guide portions 611 of the toner accommodating portion 610 is placed between the slide coupling portions 655 and the shutter body 651. Thereby, the shutter 650 may be guided by the cartridge-side guide portions 611 so as to slide.

The pair of shutter-side coupling portions 653 is disposed on a bottom surface of an end portion of the shutter 650 which is inserted into the toner accommodating portion 610. The shutter-side coupling portions 653 project toward the toner cartridge holding member 700 (downward), and formed in a mountain shape. Each of the pair of shutter-side protrusions 654 is disposed at a position adjacent to each of the pair of shutter-side coupling portions 653 on the top surface of the shutter body 651. The bottom-side projection 656 is disposed on the bottom surface of the shutter body 651. The shutter-side coupling portions 653, the shutter-side protrusions 654, and the bottom-side projection 656 will be described in detail later.

Next, a configuration of each part in a state in which the toner cartridge 600 is supported by the toner cartridge holding member 700 will be described with reference to FIGS. 5 to 9. The toner cartridge holding member 700 is fixed to a case of the image forming apparatus 1. The toner cartridge holding member 700 supports the toner cartridge 600 in a state in which the toner cartridge 600 is placed in the toner cartridge holding member 700. The toner cartridge holding member 700 is formed in a lengthy shape like the toner cartridge 600.

The toner cartridge 600 is inserted into a attaching space formed in the image forming apparatus 1, and then is slid with respect to the toner cartridge holding member 700 so as to be supported by the toner cartridge holding member 700. When the toner cartridge 600 is slid to be supported by the toner cartridge holding member 700, the bottom-side projection 656 of the shutter 650 is brought into contact with an end portion 710*a* of the toner cartridge holding member 700 (see FIG. 5) so that the sliding of the shutter 650 is restricted. Thereby, the shutter 650 is in a fixed state, and only the toner accommodating portion 610 is slid so that the discharge port 620 of the toner accommodating portion 610 becomes in an open state.

As illustrated in FIGS. 5 to 9, the toner cartridge holding member 700 includes a supporting portion (a main body portion) 710, a pair of holding member-side coupling portions 711, a pair of holding coupling portions (toner cartridge position restricting portions) 713, and a pair of holding member-side inducing portions (inducing portions) 714. The supporting portion 710 is substantially a member of a long plate shape, and supports the bottom surface of the toner cartridge 600. The supporting portion 710 is provided with an opening 710*b*. When the toner cartridge 600 is mounted to the toner cartridge holding member 700, the opening 710*b* faces the discharge port 620 (see FIG. 9). As described above, when the toner cartridge 600 is attached to the toner cartridge holding member 700, the end portion 710*a* of a side of the supporting portion 710 on which the opening 710*b* is formed is in contact with the bottom-side projection 656 of the shutter 650.

Figure 7:
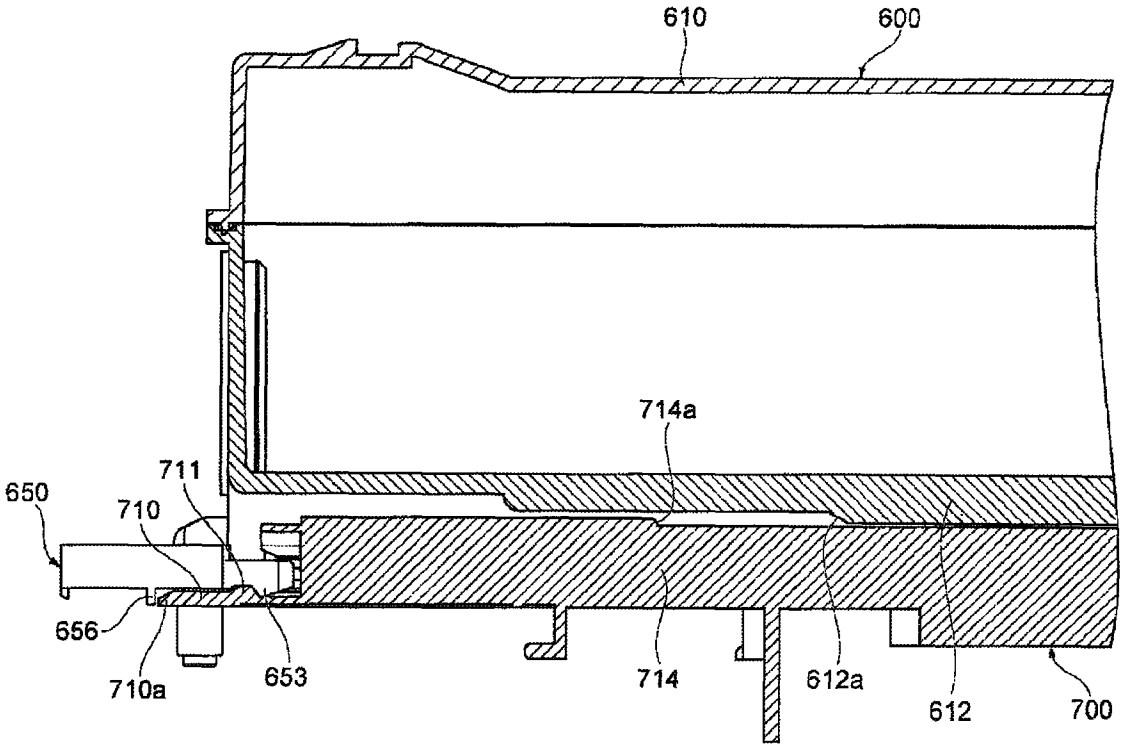
FIG. 7 is a cross-sectional view taken along a line VII-VII in FIG. 6.

The pair of holding member-side coupling portions 711 projects upwardly from the top surface of the supporting portion 710, and are formed in a mountain shape, respectively. As illustrated in FIG. 7, the holding member-side coupling portions 711 are disposed in a position where the holding member-side coupling portions 711 is coupled with the shutter-side coupling portions 653 of the shutter 650 in a state in which the toner cartridge 600 is supported by the toner cartridge holding member 700. In detail, the holding member-side coupling portions 711 are disposed on a side of a direction in which the toner cartridge 600 is pulled out (left side in FIG. 7) than the shutter-side coupling portions 653.

Figure 6:
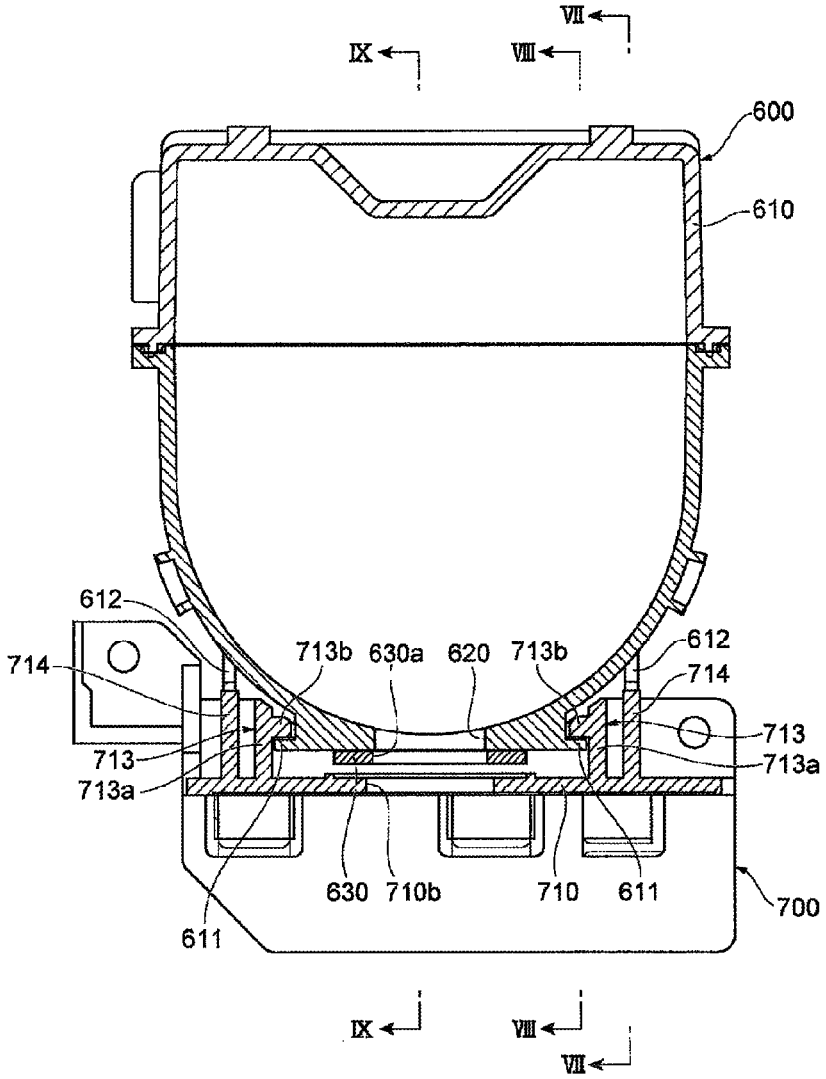
FIG. 6 is a cross-sectional view taken along a line VI-VI in FIG. 5.
Figure 8:
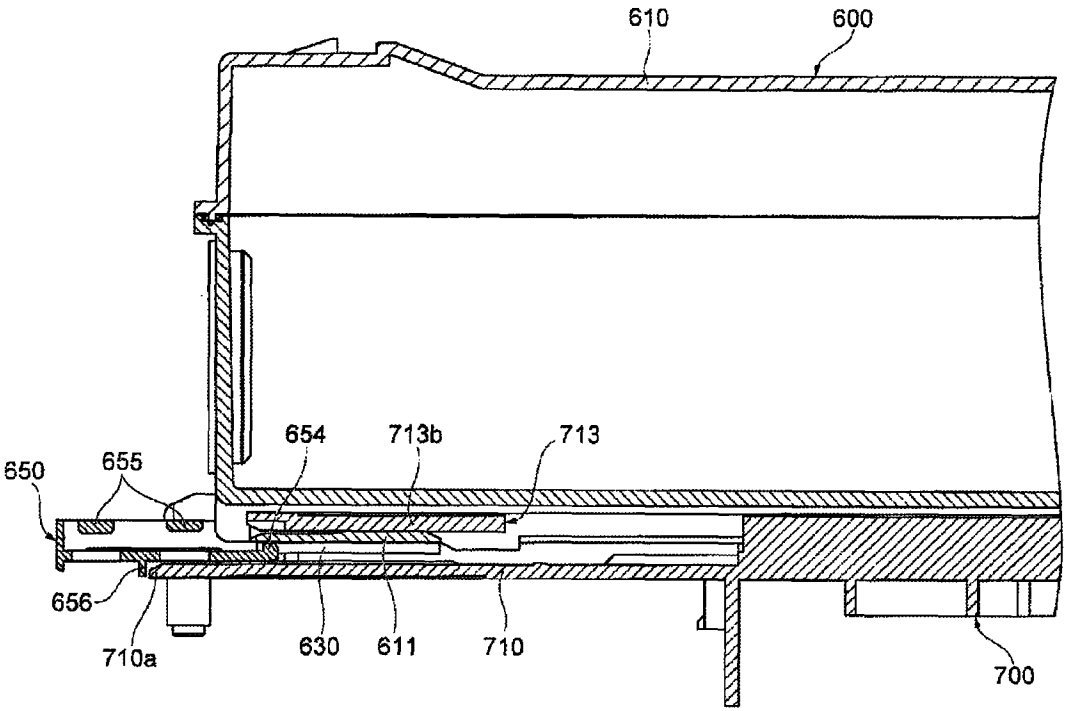
FIG. 8 is a cross-sectional view taken along a line VIII-VIII in FIG. 6.
Figure 9:
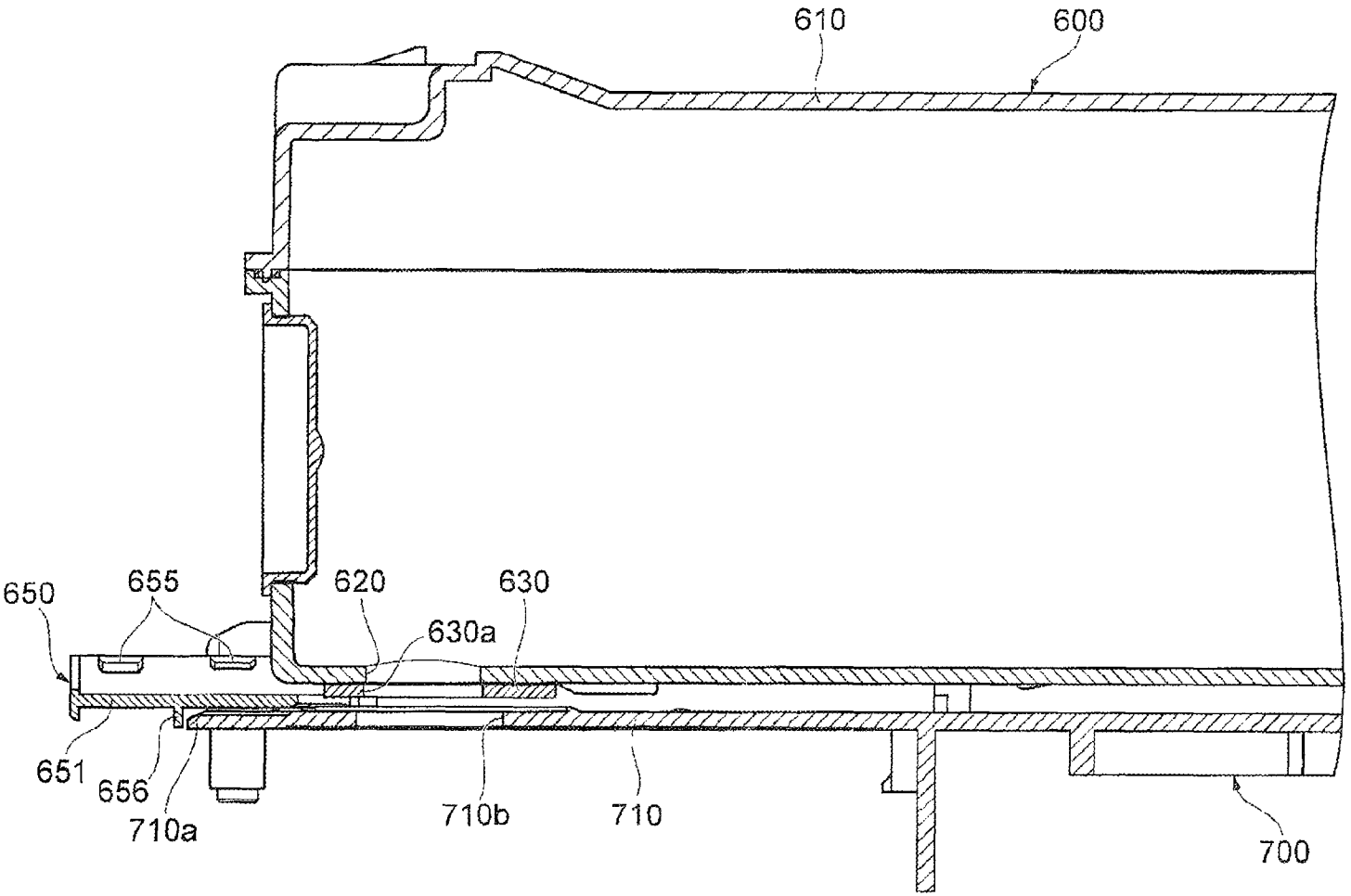
FIG. 9 is a cross-sectional view taken along a line IX-IX in FIG. 6.

The pair of holding coupling portions 713 is, as illustrated in FIGS. 6 and 8, disposed adjacent to the opening 710*b* of the supporting portion 710, and is coupled with the cartridge-side guide portions 611 of the toner accommodating portion 610. Each of the pair of holding coupling portions 713 includes a vertical part 713*a* and a protrusion 713*b*. The vertical part 713*a* is disposed on the top surface of the supporting portion 710, and is extended in the lengthwise direction of the supporting portion 710. An interval between the pair of vertical parts 713*a* is determined so that the cartridge-side guide portions 611 of the toner accommodating portion 610 can be inserted therebetween. Each of the pair of protrusions 713*b* is disposed at the top end of each of the vertical parts 713*a*, and is extended in a lengthwise direction of the vertical part 713*a*. The pair of protrusions 713*b* projects toward the opening 710*b*, respectively.

When the toner cartridge 600 is supported by the toner cartridge holding member 700, the toner cartridge 600 is slid so that the pair of cartridge-side guide portions 611 is placed between the pair of vertical parts 713*a*, and at the same time the cartridge-side guide portions 611 are placed between the supporting portion 710 and the protrusions 713*b*. Thereby, the holding coupling portions 713 are coupled with the cartridge-side guide portions 611. Due to the coupling of the holding coupling portions 713 and the cartridge-side guide portions 611, the toner cartridge 600 is restricted to be separated from the toner cartridge holding member 700.

Figure 5:
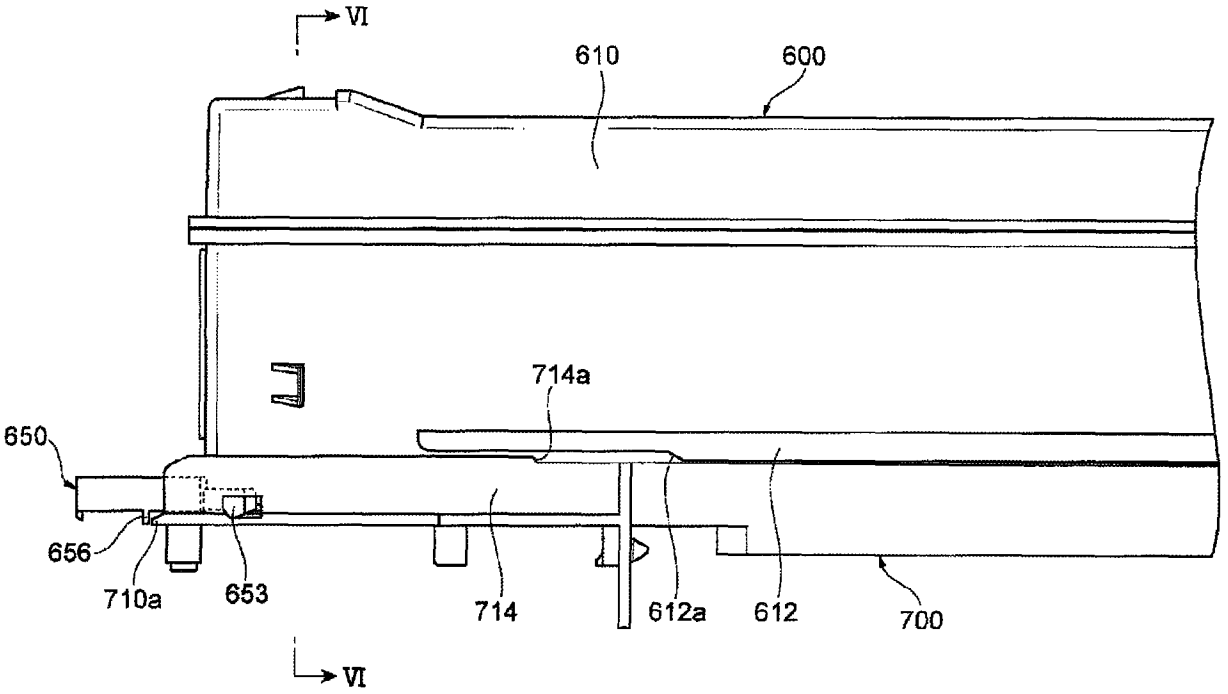
FIG. 5 is a side view illustrating a toner cartridge and a toner cartridge holding member in a state in which a discharge port is open.

The pair of holding member-side inducing portions 714 is, as illustrated in FIGS. 5 and 7, disposed on the top surface of the supporting portion 710. The holding member-side inducing portions 714 are formed in a band shape, and extended in a lengthwise direction of the supporting portion 710. The top end of the holding member-side inducing portion 714 faces the bottom end of the cartridge-side inducing portion 612 of the toner accommodating portion 610. A projecting height of the holding member-side inducing portion 714 from the supporting portion 710 is lowered from a portion of a way toward the other end portion from the end portion in which the opening 710*b* is disposed. On the other hand, the portion that varies in height in the supporting portion 710 is referred to as a step portion 714*a*. The step portion 714*a* is provided with an inclined surface. The position where the step portion 714*a* is disposed will be explained in detail later.

As illustrated in FIGS. 5 to 9, in a state in which the toner cartridge 600 is supported by the toner cartridge holding member 700, the discharge port 620 is in an open state, and the discharge port 620 of the toner accommodating portion 610 faces the opening 710*b* of the supporting portion 710. Thereby, the toner accommodating portion 610 can supply toner to the developing unit 100 through the toner cartridge holding member 700 and the toner supply path 65.

When the discharge port 620 is in an open state, there is also a case in which the shutter-side coupling portions 653 of the shutter 650 are coupled with the holding member-side coupling portions 711 of the supporting portion 710 (see FIG. 7). Further, the shutter-side protrusions 654 of the shutter 650 are in contact with the bottom surface of the cartridge-side guide portions 611 of the toner accommodating portion 610, and the holding coupling portions 713 of the toner cartridge holding member 700 are coupled with the cartridge-side guide portions 611 (see FIG. 8). Thereby, the end portion of the side of the shutter 650 on which there are the shutter-side protrusions 654 is restricted to be separated from the supporting portion 710. As a result, the coupling between the shutter-side coupling portions 653 of the shutter 650 and the holding member-side coupling portions 711 of the supporting portion 710 is maintained.

Also, although the coupling between the slide coupling portions 655 of the shutter 650 and the cartridge-side guide portions 611 of the toner accommodating portion 610 is released, the shutter-side coupling portions 653 of the shutter 650 are coupled with the holding member-side coupling portions 711 of the supporting portion 710, and the holding coupling portions 713 of the toner cartridge holding member 700 are coupled with the cartridge-side guide portions 611 so that the shutter 650 does not fall off from the toner cartridge holding member 700. Further, due to the coupling of the holding coupling portions 713 of the toner cartridge holding member 700 and the cartridge-side guide portions 611, it is restricted that the toner cartridge 600 is separated from the toner cartridge holding member 700. The coupling between the shutter-side coupling portions 653 of the toner cartridge 600 and the holding member-side coupling portions 711 of the supporting portion 710 is maintained more reliably by restricting the separation of the toner cartridge 600.

Figure 13:
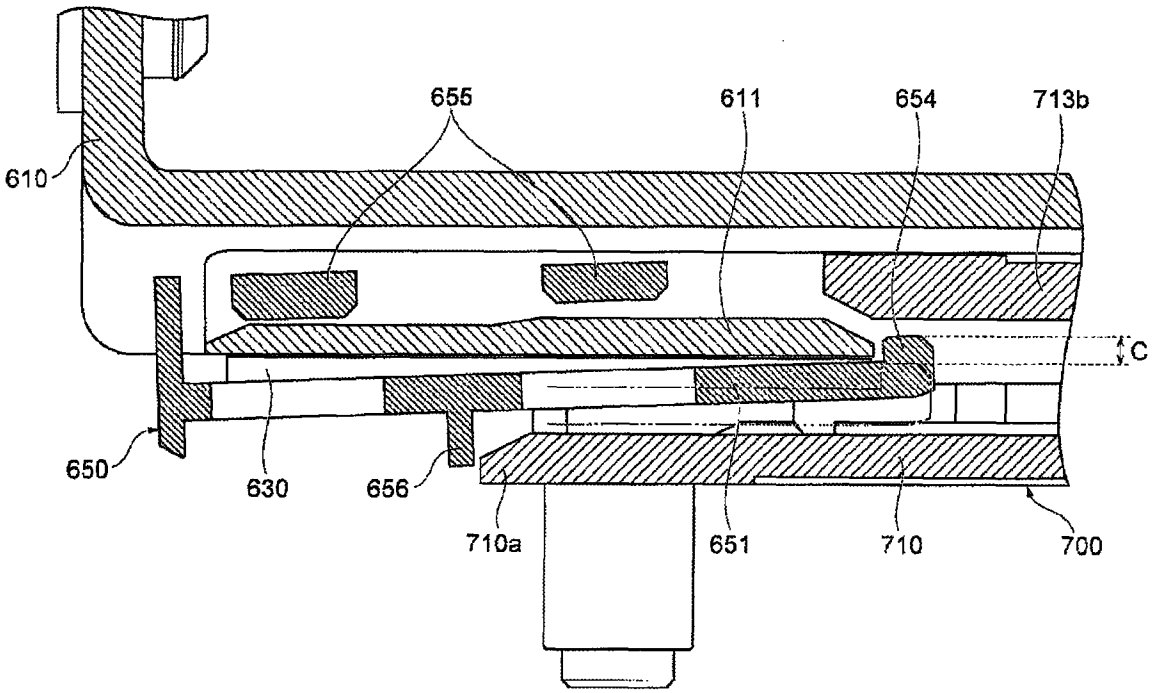
FIG. 13 is a cross-sectional view illustrating movement of a shutter in a state in which coupling between a cartridge-side guide portion and a shutter-side projecting portion is released.
Figure 14:
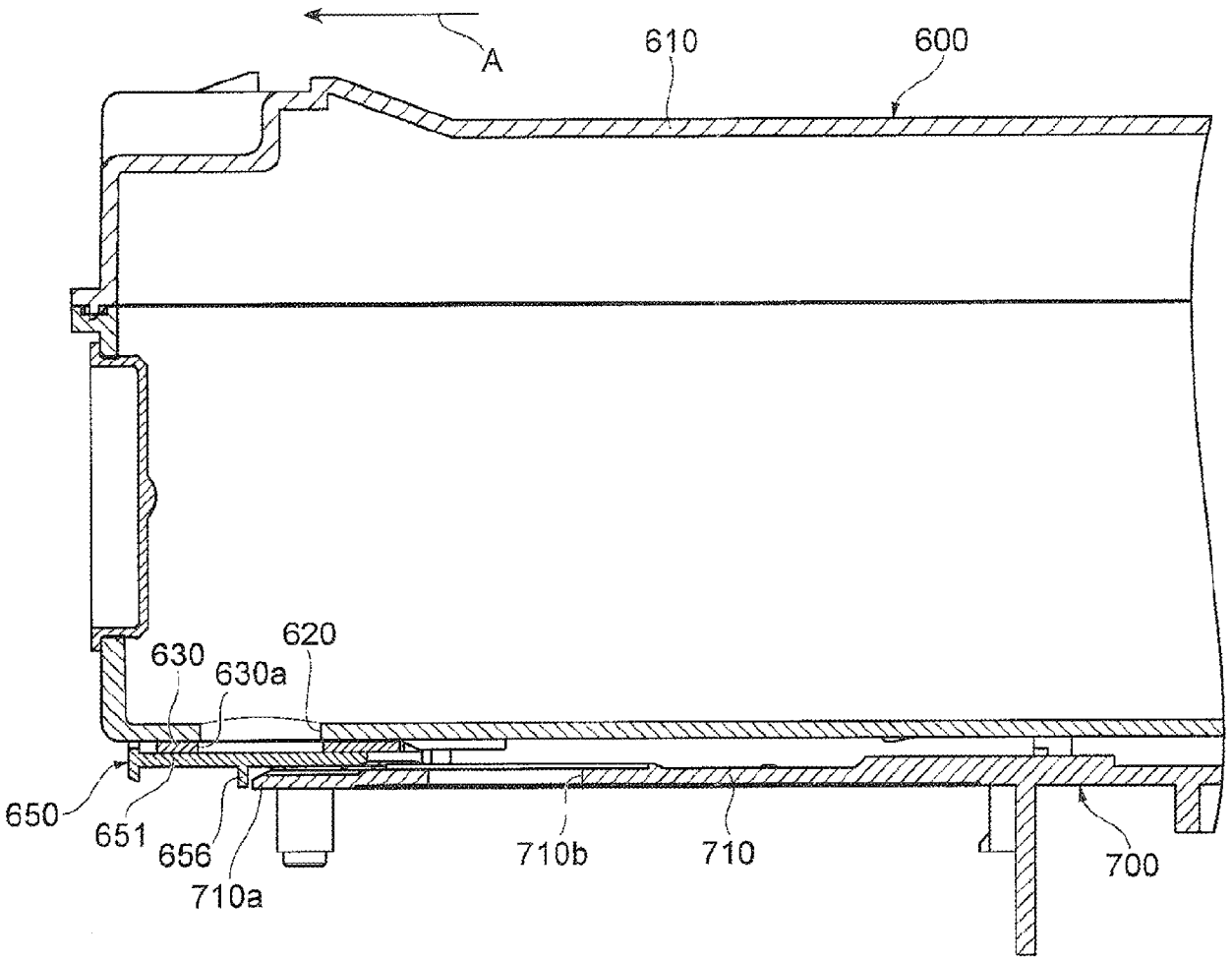
FIG. 14 is a cross-sectional view illustrating a periphery of a discharge port in a state in which the discharge port is closed.

Next, in a state in which the toner cartridge 600 is supported by the toner cartridge holding member 700, a case of separating the toner cartridge 600 by sliding the toner cartridge 600 will be described. As illustrated in FIGS. 10 to 14, if the toner cartridge 600 is slid in a separating direction (a direction indicated as an arrow A in FIGS. 10, 11, 12, and 14) with respect to the toner cartridge holding member 700, since the shutter-side coupling portions 653 of the shutter 650 are coupled with the holding member-side coupling portions 711, only the toner accommodating portion 610 is slid. Thereby, as illustrated in FIG. 14, the discharge port 620 of the toner accommodating portion 610 is covered and closed by the shutter 650.

When the toner accommodating portion 610 is slid, after the discharge port 620 of the toner accommodating portion 610 is closed by the shutter 650, the coupling between the cartridge-side guide portions 611 of the toner accommodating portion 610 and the holding coupling portions 713 of the toner cartridge holding member 700 is released. Then, the cartridge-side guide portions 611 are coupled with the slide coupling portions 655 of the shutter 650 (see FIG. 12). Thereby, the toner cartridge 600 can be separated from the toner cartridge holding member 700. Also, even when the toner cartridge 600 is separated from the toner cartridge holding member 700, the shutter 650 is in a state in which the shutter 650 is attached to the toner accommodating portion 610.

Figure 12:
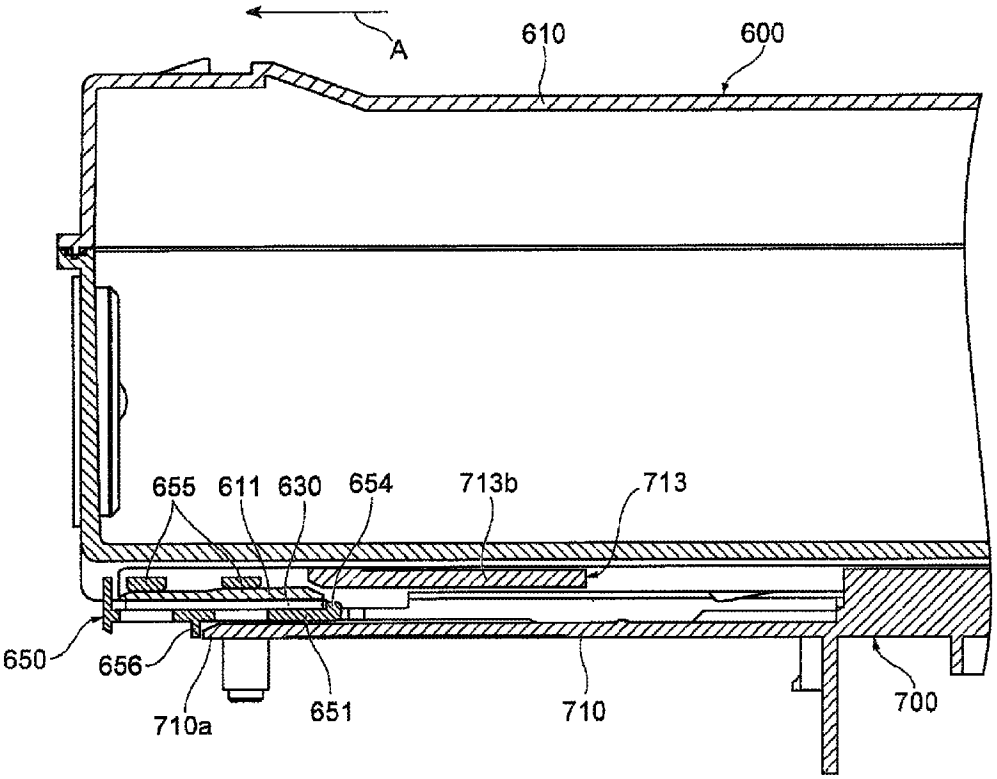
FIG. 12 is a cross-sectional view illustrating a state in which coupling between a cartridge-side guide portion and a shutter-side projecting portion is released in a state in which a discharge port is closed.

Further, while the toner accommodating portion 610 is being slid in the separating direction until the discharge port 620 is closed by the shutter 650, as illustrated in FIGS. 8 and 12, the shutter-side protrusions 654 are in contact with the bottom surface of the cartridge-side guide portions 611. When the toner accommodating portion 610 is slid to a position where the discharge port 620 is closed by the shutter 650, the contact between the shutter-side protrusions 654 of the shutter 650 and the bottom surface of the cartridge-side guide portions 611 is released (see FIG. 12). Accordingly, since the shutter-side protrusions 654 of the shutter 650 is in contact with the bottom surface of the cartridge-side guide portions 611 until the discharge port 620 is closed by the shutter 650, the separation of the shutter 650 is restricted. Also, since the holding coupling portions 713 of the toner cartridge holding member 700 is coupled with the cartridge-side guide portions 611, the separation of the cartridge is restricted. Thereby, the coupling state of the shutter-side coupling portions 653 of the shutter 650 and the holding member-side coupling portions 711 of the supporting portion 710 is maintained securely. Accordingly, when sliding the toner accommodating portion 610, the discharge port 620 can be reliably closed by the shutter 650. Further, after the shutter 650 closes the discharge port 620, as illustrated in FIG. 13, the shutter 650 may be moved in a direction closer to the toner accommodating portion 610 while compressing the seal member 630. This moving direction is a direction of releasing the coupling between the shutter-side coupling portions 653 of the shutter 650 and the holding member-side coupling portions 711 of the supporting portion 710.

Figure 11:
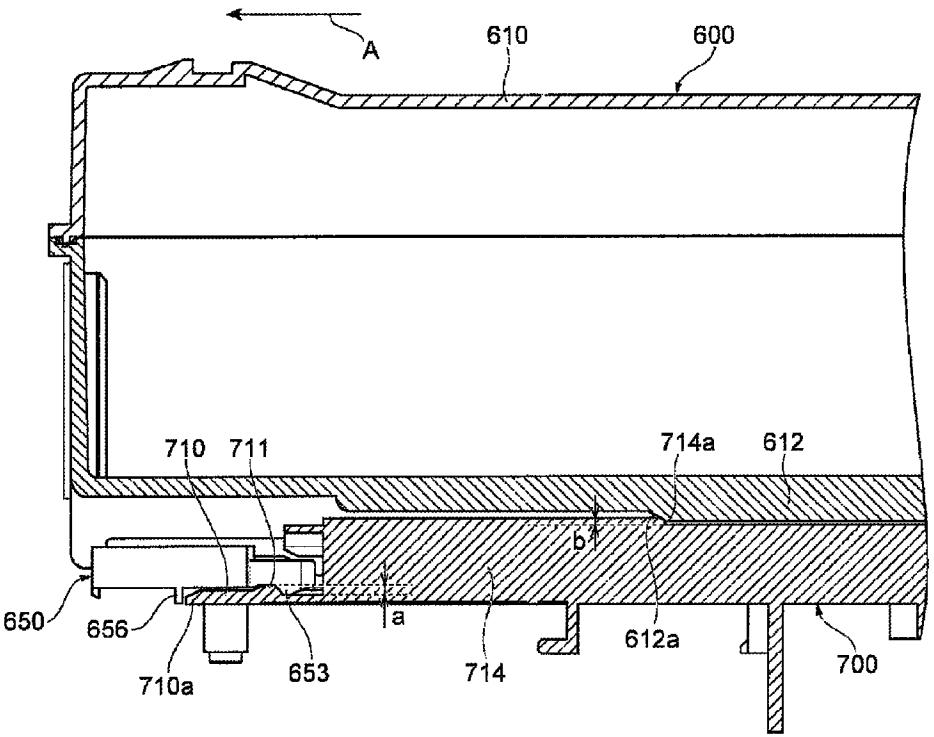
FIG. 11 is a cross-sectional view illustrating peripheries of a surrounding of a shutter-side coupling portion and a holding member-side coupling portion in a state in which a discharge port is closed.

Further, the shutter-side coupling portion 653 is formed in a mountain shape. For this reason, as illustrated in FIG. 11, if the toner accommodating portion 610 is further slid in the state in which the discharge port 620 is closed by the shutter 650, the shutter 650 is moved in a direction in which the shutter-side coupling portions 653 climb up the holding member-side coupling portions 711. Even in this case, as described above, since the coupling between the cartridge-side guide portions 611 and the shutter-side protrusions 654 of the shutter 650 is released, the movement of the shutter 650 is not inhibited by the shutter-side coupling portions 653 climbing over the holding member-side coupling portions 711.

Figure 10:
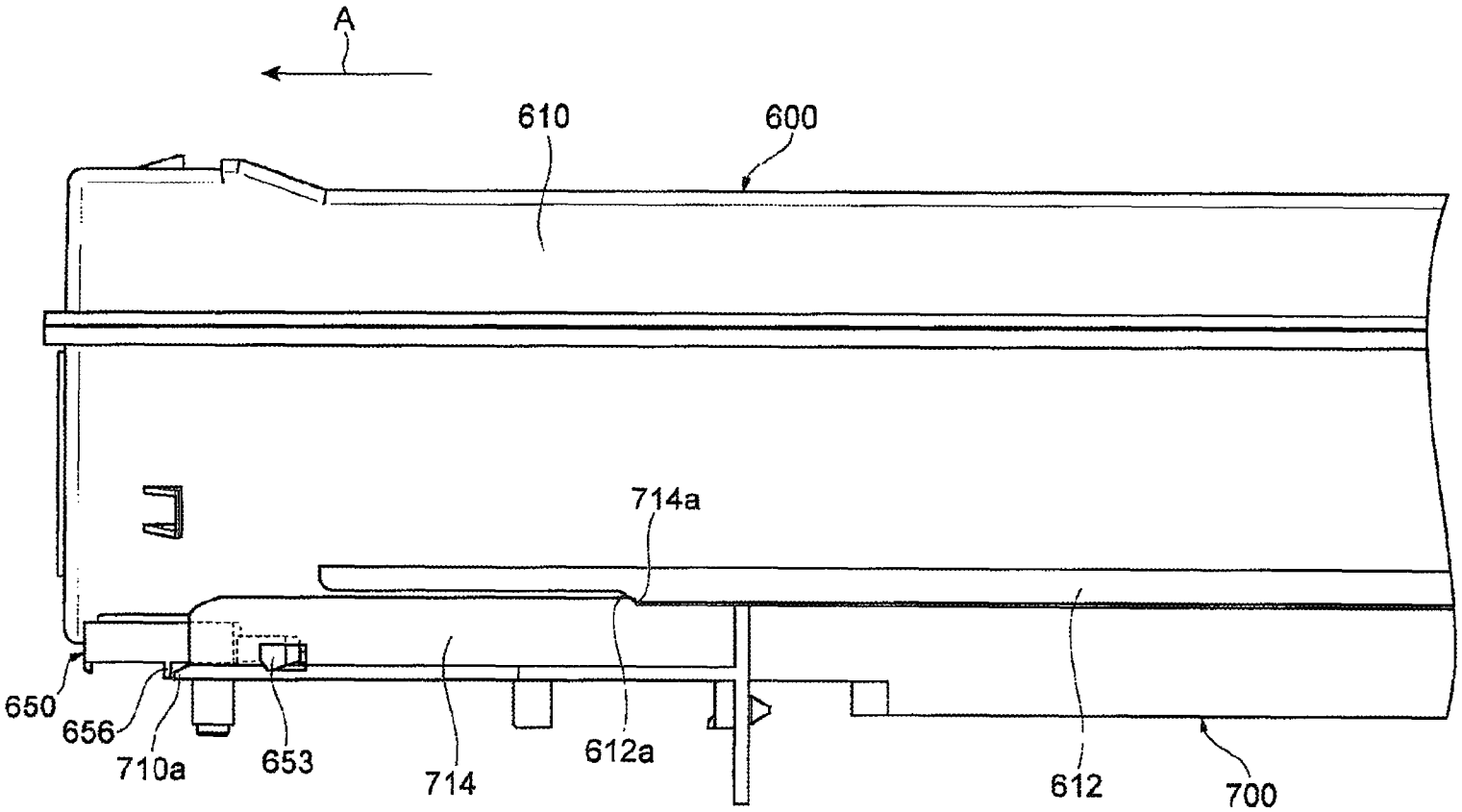
FIG. 10 is a side view illustrating a toner cartridge and a toner cartridge holding member in a state in which a discharge port is closed.

Also, as illustrated in FIG. 10, in a sliding position of the toner accommodating portion 610 when the discharge port 620 is closed by the shutter 650, the step portions 612*a* of the cartridge-side inducing portions 612 are in contact with the step portions 714*a* of the holding member-side inducing portions 714. If the toner accommodating portion 610 is slid further from this state, the step portion 612*a* of the cartridge-side inducing portion 612 climbs up the step portion 714*a* of the holding member-side inducing portion 714. Thereby, the toner cartridge 600 is induced in the direction of rising with respect to the toner cartridge holding member 700. In other words, the toner cartridge 600 is moved in a direction in which the coupling between the shutter-side coupling portions 653 of the shutter 650 and the holding member-side coupling portions 711 of the supporting portion 710 is released.

Here, a height of the shutter-side coupling portions 653 of the shutter 650 and the holding member-side coupling portions 711 of the supporting portion 710 coupled with each other is referred to as a coupling height a (see FIG. 11). A height to which the toner cartridge 600 is induced by the step portions 612*a* of the cartridge-side inducing portions 612 climbing up the step portions 714*a* of the holding member-side inducing portions 714 is referred to as an induced height b (see FIG. 11). In the state in which the shutter 650 closes the discharge port 620, a height to which the shutter 650 is moved toward the toner accommodating portion 610 while compressing the seal member 630 is referred to as a moving height c (see FIG. 13). In this case, heights of the parts, etc. are determined so that the coupling height a, the induced height b, and the moving height c satisfy a relationship of $\lceil a-b \leq c$, where $c \neq 0 \rfloor$.

Or, in this embodiment, the coupling height a, and the induced height b may satisfy a relationship of $a \leq b$. When the toner cartridge 600 is induced by the holding member-side inducing portions 714, since the induced height b is set to a height higher than the coupling height a, the shutter-side coupling portions 653 is easy to climb over the holding member-side coupling portions 711. Therefore, it is possible to facilitate the sliding operation for separating the toner cartridge 600.

If the toner accommodating portion 610 is slid further in the state in which the discharge port 620 is closed by the shutter 650, the coupling between the shutter-side protrusions 654 of the shutter 650 and the bottom surface of the cartridge-side guide portions 611 is released so that the shutter 650 is able to move toward the toner accommodating portion 610. Also, the coupling between the holding coupling portions 713 of the toner cartridge holding member 700 and the cartridge-side guide portions 611 is released so that the toner cartridge 600 is able to move in a direction in which the toner cartridge 600 is lifted up. Furthermore, the step portions 612*a* of the cartridge-side inducing portions 612 climb up the step portions 714*a* of the holding member-side inducing portions 714. Furthermore, the shutter-side coupling portions 653 of the shutter 650 climb up the holding member-side coupling portions 711 of the supporting portion 710. Thereby, in the state in which the discharge port 620 is closed by the shutter 650, the toner cartridge 600 can be pulled out from the toner cartridge holding member 700.

In the toner supply apparatus 60 according to the present embodiment configured as described above, the shutter 650 closes the discharge port 620 of the toner accommodating portion 610 by the sliding operation for separating the toner cartridge 600. Therefore, the discharge port 620 may be reliably closed by the shutter 650 in a simple structure in which the other mechanism for sliding the shutter 650 is not installed. After the discharge port 620 is closed by the shutter 650, the toner cartridge 600 is induced in the direction in which the coupling between the shutter-side coupling portions 653 of the shutter 650 and the holding member-side coupling portions 711 of the supporting portion 710 is released by the step portions 612*a* of the cartridge-side inducing portions 612 climbing up the step portions 714*a* of the holding member-side inducing portions 714. Thus, by the sliding operation for separating the toner cartridge 600, the coupling between the shutter-side coupling portions 653 and the holding member-side coupling portions 711 may be released by a simple configuration.

Since the shutter-side protrusions 654 of the shutter 650 are in contact with the bottom surface of the cartridge-side guide portions 611 until the discharge port 620 is closed by the shutter 650, the movement of the shutter 650 is restricted. Furthermore, since the holding coupling portions 713 of the toner cartridge holding member 700 are coupled with the cartridge-side guide portions 611, that the cartridge is lifted is restricted. Thereby, the shutter-side coupling portions 653 may be securely coupled with the holding member-side coupling portions 711, and the shutter 650 may be reliably slid to the closing position of the discharge port 620.

The shutter 650 becomes able to move in the direction in which the coupling between the shutter-side coupling portions 653 and the holding member-side coupling portions 711 is released by that the coupling between the shutter-side protrusions 654 and the bottom surface of the cartridge-side guide portions 611 is released in the closing position of the discharge port 620. In this case, the shutter 650 moves in the direction in which the coupling between the shutter-side coupling portions 653 and the holding member-side coupling portions 711 is released. Accordingly, the coupling between the shutter-side coupling portions 653 and the holding member-side coupling portions 711 may be released by the aforementioned movement of the shutter 650 and a movement of the shutter 650 by the step portion 612*a* of the cartridge-side inducing portions 612 being induced to climb up the step portions 714*a* of the holding member-side inducing portions 714. In other words, it is possible to reduce a moving width of the toner cartridge 600 in the direction in which the coupling between the shutter-side coupling portions 653 and the holding member-side coupling portions 711 is released compared to a case in which the coupling between the shutter-side coupling portions 653 and the holding member-side coupling portions 711 is released by only inducing the shutter 650 by the holding member-side inducing portions 714 and the cartridge-side inducing portions 612. Accordingly, since the moving width of the toner cartridge 600 for releasing the coupling between the shutter-side coupling portions 653 and the holding member-side coupling portions 711 can be reduced, the miniaturization of the toner supply apparatus 60 may be possible.

A height of the shutter-side coupling portions 653 of the shutter 650 and the holding member-side coupling portions 711 of the supporting portion 710 coupled with each other is referred to as a coupled height a. A height to which the toner cartridge 600 is induced by the step portion 612*a* of the cartridge-side inducing portion 612 climbing up the step portion 714*a* of the holding member-side inducing portion 714 is referred to as a induced height b. In the state in which the shutter 650 closes the discharge port 620, a height to which the shutter 650 is moved toward the toner accommodating portion 610 while compressing the seal member 630 is referred to as a moving height c. In this case, heights of the parts, etc. are determined so that the coupled height a, the induced height b, and the moving height c satisfy the relationship of [a−b≤c, where c≠0]. By setting the individual parts so as to satisfy the relationship, it is possible to reliably release the coupling between the shutter-side coupling portions 653 and the holding member-side coupling portions 711 while the discharge port 620 is being closed by the shutter 650.

The holding member-side coupling portions 711 and the cartridge-side guide portions 611 are coupled with each other in the sliding position of the toner accommodating portion 610 from a state in which the discharge port 620 is open to when the toner accommodating portion 610 is slid in the separating direction so that the discharge port 620 is closed by the shutter 650. In this case, the toner cartridge 600 is restricted to be detached from the toner cartridge holding member 700 until the discharge port 620 is closed by the shutter 650. Accordingly, the shutter-side coupling portions 653 are caused to be securely coupled with the holding member-side coupling portions 711. Thereby, the shutter 650 may be reliably slid to the closing position of the discharge port 620.

Next, a toner supply apparatus provided with a toner cartridge according to another embodiment of the present disclosure will be described. In the toner supply apparatus according to the present embodiment, a configuration of a shutter, etc. is to partially modify the configuration of the shutter 650, etc. of the toner supply apparatus according to the above-described embodiment. Hereinafter, the same numerals are given for the same components as the above-described embodiment, and duplicate description is omitted.

Figure 15:
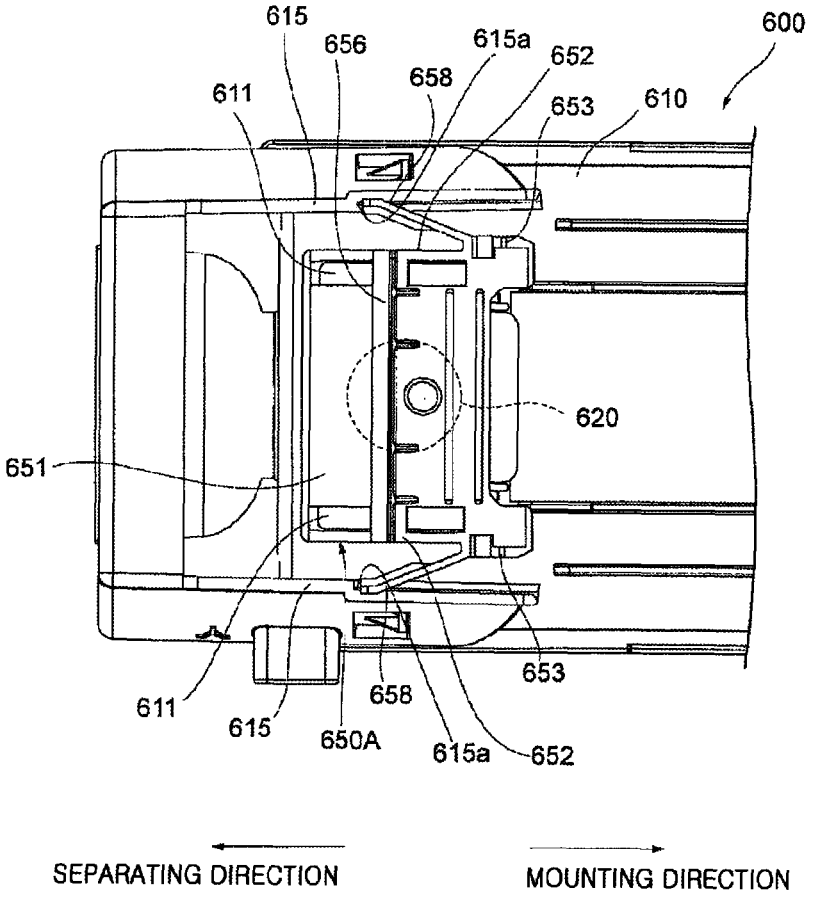
FIG. 15 is a bottom view illustrating a state in which a discharge port of a toner cartridge is closed by a shutter.

As illustrated in FIG. 15, a shutter 650A is attached to the toner accommodating portion 610. A pair of cartridge-side guide portions 611 extending in the lengthwise direction of the toner accommodating portion 610 is disposed on the outer surface of the toner accommodating portion 610 (see FIG. 2).

The shutter 650A is disposed in the toner accommodating portion 610 to slide along the cartridge-side guide portions 611 in the same way as the above-described embodiment. The discharge port 620 is formed in the bottom surface of the toner accommodating portion 610 (see FIG. 2). As illustrated in FIG. 15, the discharge port 620 is closed by the slid shutter 650A.

Figure 16:
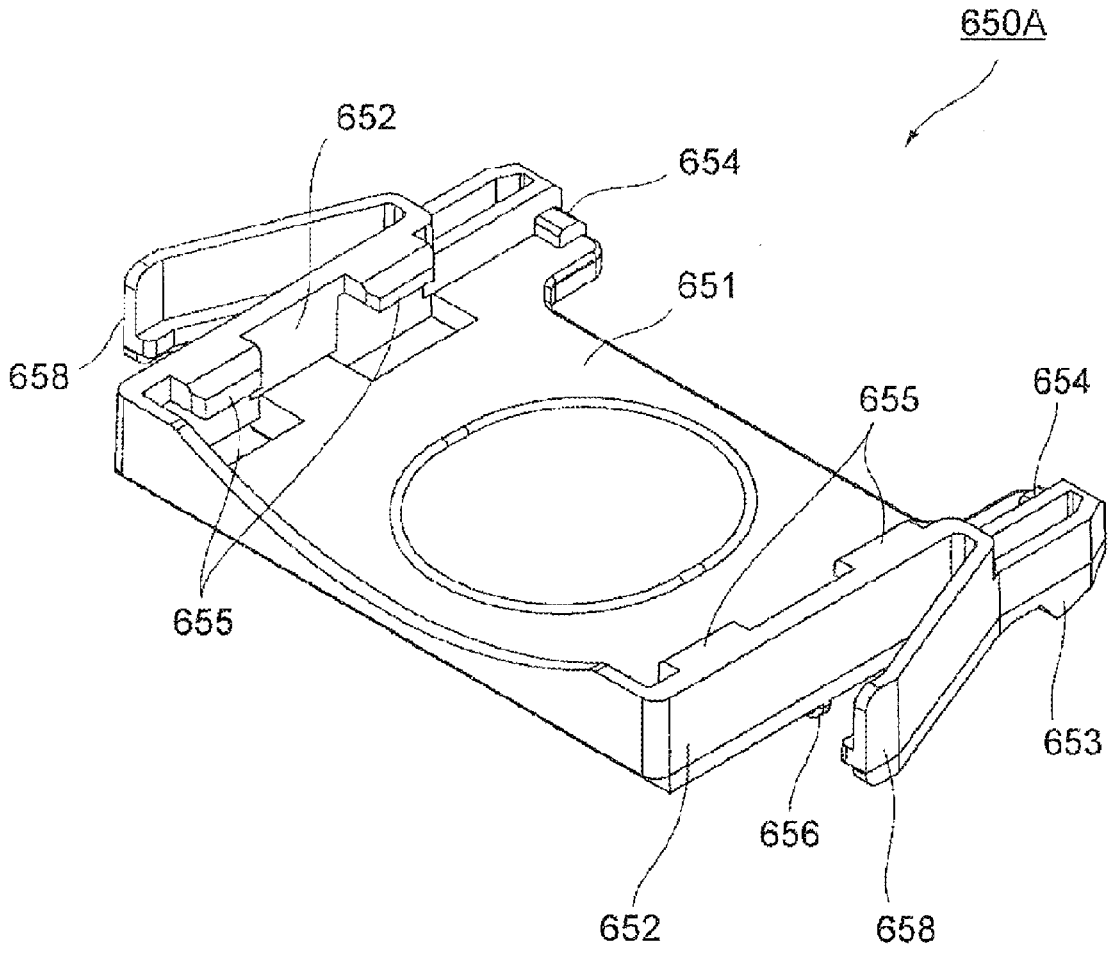
FIG. 16 is a perspective view illustrating a shutter.

As illustrated in FIGS. 15 and 16, the shutter 650A includes a shutter body 651, a pair of side-walls 652, a pair of shutter-side coupling portions 653, a pair of shutter-side protrusions 654, a plurality of slide coupling portions 655, a bottom-side projection 656, and a pair of action restricting portions 658. The pair of action restricting portions 658 is disposed on the outer surfaces of the pair of side-walls 652, respectively. The action restricting portion 658 is formed in a plate shape. One end of the action restricting portion 658 in the sliding direction of the shutter 650A is attached to the outer surface of the side-wall 652. Here, the one end of the action restricting portion 658 is an end, which is on the side of the mounting direction of the toner cartridge 600, of the opposite ends, which are in the sliding direction, of the action restricting portions 658. Also, the mounting direction is a direction opposite to the direction in which the toner cartridge 600 is separated from the toner cartridge holding member 700.

The other end of the action restricting portions 658 is spaced apart from the outer surface of the side-wall 652. In other words, the pair of action restricting portions 658 is provided on the side-walls 652 so as to be gradually widened from the pair of side-walls 652 from the end, which is on the side of the mounting direction of the toner cartridge 600, toward the end, which is on the side of the separating direction side.

The toner accommodating portion 610 includes a pair of wall portions 615. An interval between the pair of wall portions 615 is determined so that the shutter body 651 of the shutter 650A can be inserted between the pair of wall portions 615. When the shutter 650A is mounted to the cartridge-side guide portions 611, the pair of wall portions 615 faces the pair of side-walls 652, respectively. The action restricting portions 658 restrict the sliding operation of the shutter 650A with respect to the toner accommodating portion 610 in the position where the shutter 650A closes the discharge port 620. In detail, in the position where the shutter 650A closes the discharge port 620, the end of the action restricting portion 658 extending away from the side-wall 652 is coupled with a step portion 615*a* disposed in each of the wall portions 615. Thereby, to slide the shutter 650A in the separation direction of the toner cartridge 600 is restricted.

Figure 17:
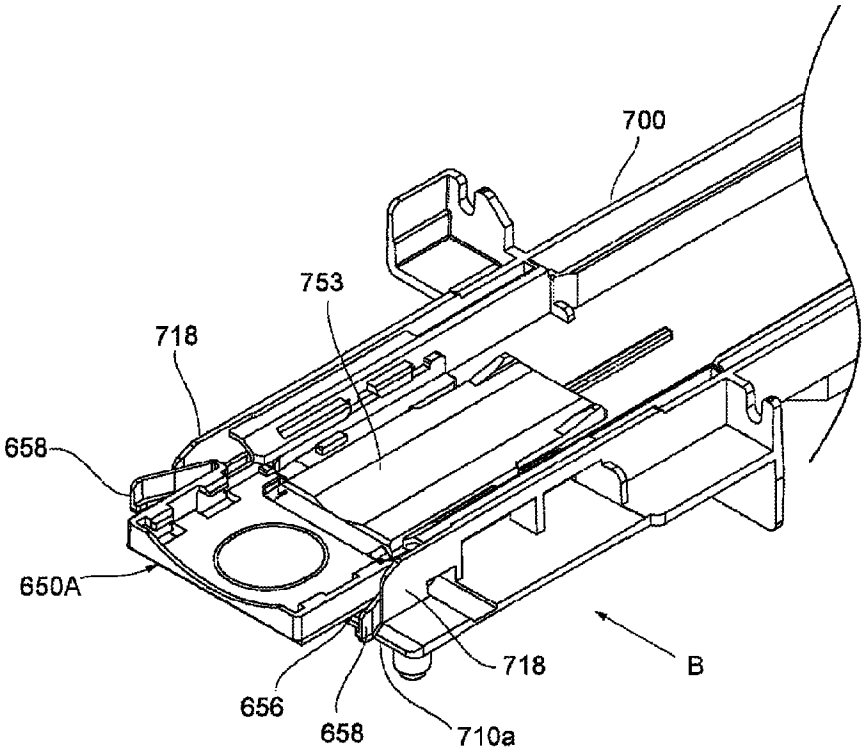
FIG. 17 is a perspective view illustrating a state in which a shutter and a restriction releasing portion of a toner cartridge holding member are coupled with each other.
Figure 18A:
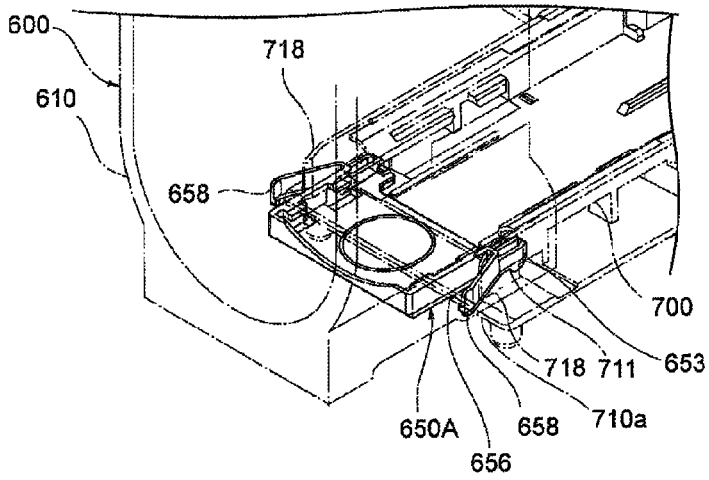
FIG. 18A is a perspective view illustrating a state of a shutter immediately after restriction of a sliding operation of the shutter is released.
Figure 18B:
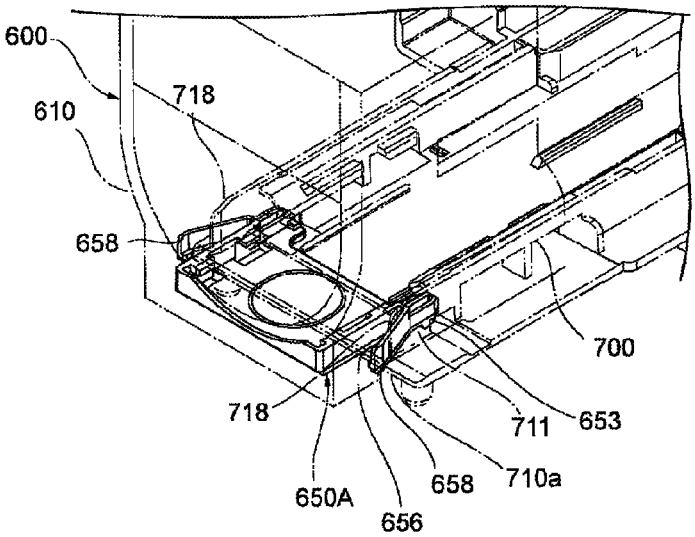
FIG. 18B is a perspective view illustrating a state in which a toner accommodating portion is further slid from the state of FIG. 18A.

Next, restriction of the sliding operation of the shutter 650A and release of the restriction thereof will be described with reference to FIGS. 17, 18A, and 18B. FIG. 17 does not illustrate the toner accommodating portion 610, etc. for illustrating the surrounding of the shutter 650A.

The toner cartridge holding member 700 includes a pair of restriction releasing portions 718. The restriction releasing portions 718 are formed perpendicular to a surface of the supporting portion 710 onto which the toner cartridge 600 is attached. The restriction releasing portions 718 are extended along the sliding direction of the toner cartridge 600. An interval between the pair of restriction releasing portions 718 is determined so that the shutter body 651 of the shutter 650A can be inserted therebetween. Further, the interval between the pair of restriction releasing portions 718 is determined so that, when the shutter body 651 is inserted between the pair of the restriction releasing portions 718, each of the pair of restriction releasing portions 718 is coupled with each of the pair of action restricting portions 658.

First, when the toner cartridge 600 is mounted, operation of the shutter 650A will be described. Like the above-described embodiment, when the toner cartridge 600 is slid in the mounting direction, the bottom-side projection 656 is brought into contact with the end portion (holding member-side shutter coupling portions) 710*a* of the toner cartridge holding member 700. At this time, an end of each of the pair of restriction releasing portions 718 is in contact with each of the pair of action restricting portions 658. Thereby, the interval between the pair of action restricting portions 658 is narrowed by the restriction releasing portions 718.

If the interval between the pair of action restricting portions 658 is narrowed, the coupling between the ends of the action restricting portions 658 and the step portions 615*a* of the wall portions 615 is released. The shutter 650A becomes able to slide with respect to the toner accommodating portion 610 due to the release of the coupling. In other words, the restriction of the sliding operation of the shutter 650A by the action restricting portions 658 is released. Also, FIGS. 17 and 18A illustrate a state immediately after the coupling between the ends of the action restricting portions 658 and step portions 615*a* of the wall portions 615 is released.

When the restriction of the sliding operation by the action restricting portions 658 is released, and then the toner accommodating portion 610 is slid further in the mounting direction, only the toner accommodating portion 610 is slid in a state in which the shutter 650A is fixed with respect to the supporting portion 710. Thereby, the discharge port 620 of the toner accommodating portion 610 becomes in an open state. Also, FIG. 18B illustrates a state in which only the toner accommodating portion 610 is slid further from the state illustrated in FIG. 18A so that the discharge port 620 is open.

Next, when the toner cartridge 600 is separated, operation of the shutter 650A will be described. If the toner accommodating portion 610 is slid in the separating direction, after the discharge port 620 is closed by the shutter 650A, the end portion 710*a* of the supporting portion 710 is spaced apart from the bottom-side projection 656. At this time, the coupling between the ends of the restriction releasing portions 718 and the action restricting portions 658 is released. Also, the coupling between the shutter-side coupling portions 653 and the holding member-side coupling portions 711 is released by the shutter-side coupling portions 653 climbing over the holding member-side coupling portions 711. In this way, by releasing the coupling between the ends of the restriction releasing portions 718 and the action restricting portions 658, the action restricting portions 658 restrict the sliding operation of the shutter 650A with respect to the toner accommodating portion 610. In other words, when the coupling between the shutter-side coupling portions 653 and the holding member-side coupling portions 711 is released, the restriction releasing portions 718 allow the action restricting portions 658 to restrict the sliding operation of the shutter 650A.

Configuration of the surrounding of the seal member (a cartridge-side seal member) 630 will be described with reference to FIGS. 19 to 22. The toner cartridge 600 is the same as that of the above-described embodiment, and includes a seal member 630. The seal member 630 is disposed to surround the periphery of the discharge port 620. The seal member 630 is formed of an elastic material.

The toner cartridge holding member 700 includes a holding member-side seal member 760. Like the above-described embodiment, an opening (a toner supply port) 710*b* is provided in the supporting portion 710 of the toner cartridge holding member 700. The holding member-side seal member 760 is formed of an elastic material.

Figure 22:
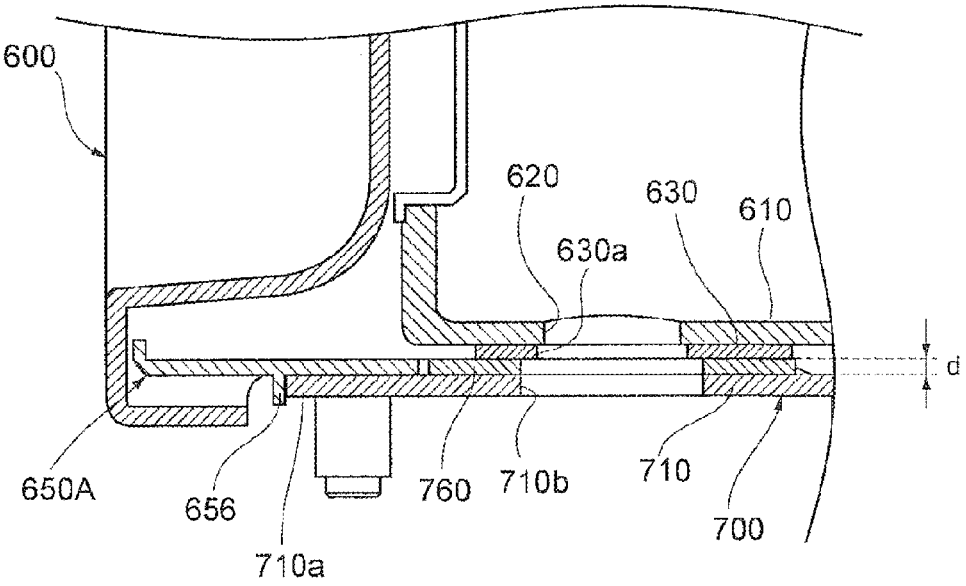
FIG. 22 is a cross-sectional view illustrating a state in which a discharge port and an opening are in communication with each other.

When the toner accommodating portion 610 is placed in the toner supply position where the toner accommodating portion 610 supplies toner to the toner cartridge holding member 700, the opening 710*b* is in communication with the discharge port 620 (see FIG. 22).

Also, the holding member-side seal member 760 surrounds the periphery of the opening 710*b*, and seals a gap between the seal member 630 and the supporting portion 710 when the toner accommodating portion 610 is placed in the toner supply position.

Figure 19A:
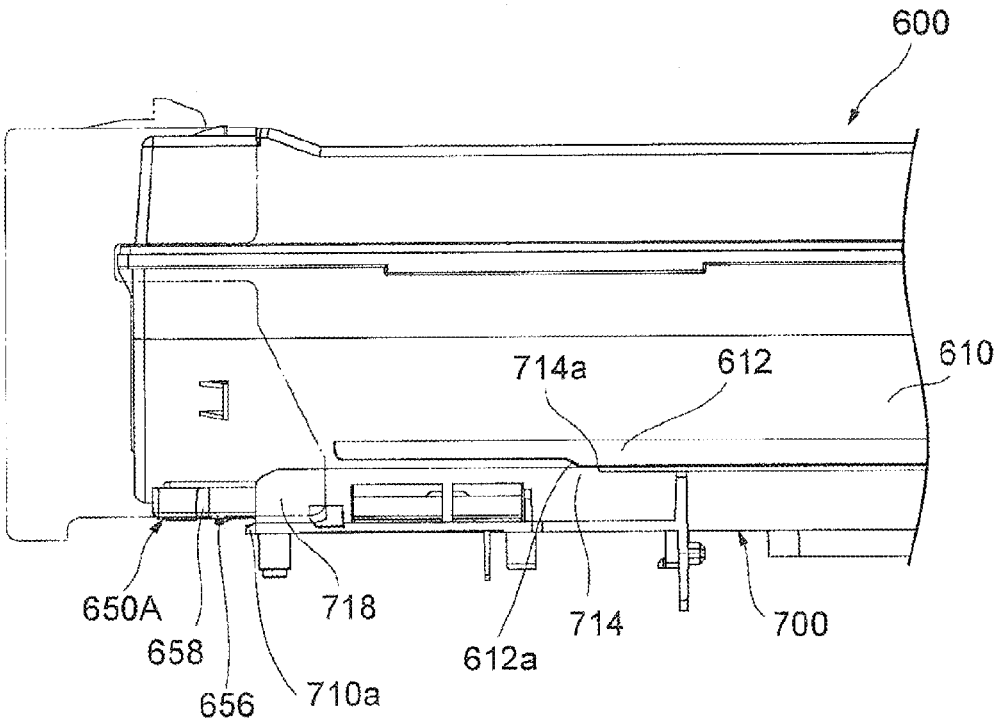
FIG. 19A is a side view illustrating a toner cartridge and a toner cartridge holding member for explaining a state of a seal member when the toner cartridge is slid in a mounting direction.
Figure 19B:
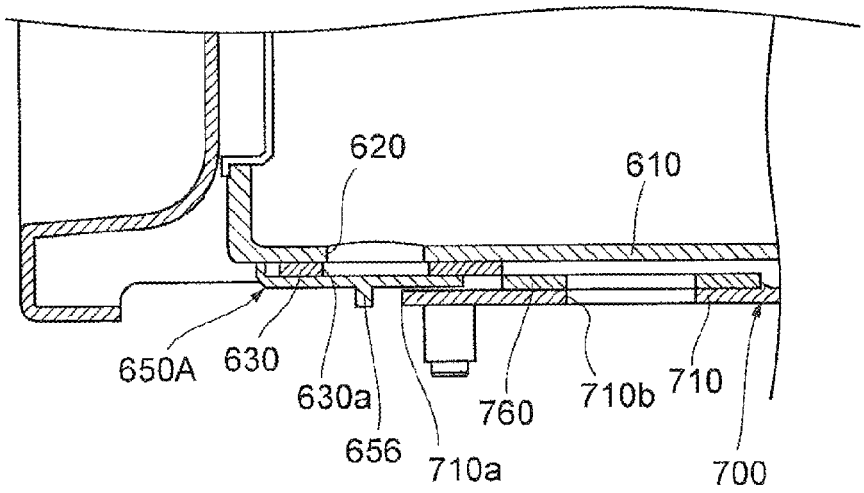
FIG. 19B is a cross-sectional view illustrating a periphery of the seal member for explaining a state of the seal member when the toner cartridge is slid in a mounting direction.
Figure 20A:
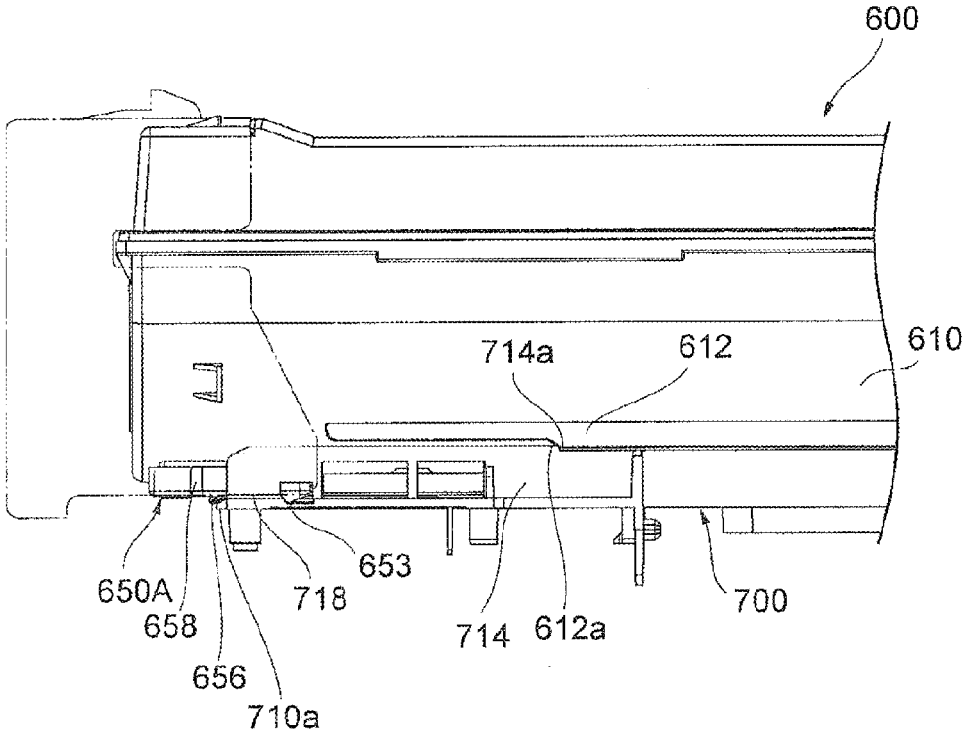
FIG. 20A is a side view illustrating a toner cartridge and a toner cartridge holding member for explaining a state of a seal member when the toner cartridge is slid in a mounting direction.
Figure 20B:
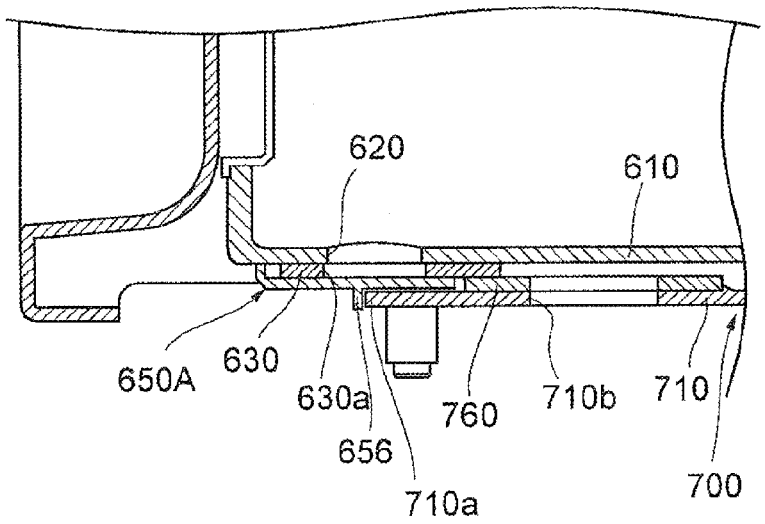
FIG. 20B is a cross-sectional view illustrating a periphery of the seal member for explaining a state of the seal member when the toner cartridge is slid in a mounting direction.

FIGS. 19 to 22 illustrate a shape which the seal member 630 and the holding member-side seal member 760 overlap when the toner cartridge 600 is mounted to the toner cartridge holding member 700. On the other hand, in the order of FIG. 19, FIG. 20, FIG. 21, and FIG. 22 they illustrate that the toner cartridge 600 is slid in the mounting direction. In detail, FIG. 19 illustrates a state in which the toner cartridge 600 is slid in the mounting direction before the seal member 630 and the holding member-side seal member 760 overlap. FIG. 20 illustrates a state in which the toner cartridge 600 is slid further in the mounting direction so that the seal member 630 and the holding member-side seal member 760 are overlapped.

Figure 21A:
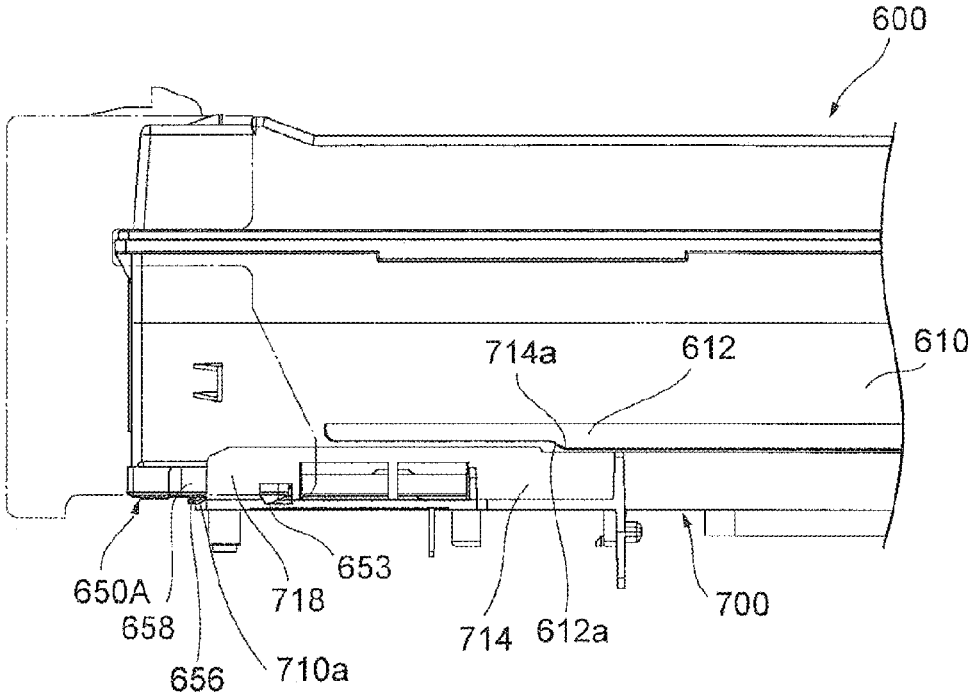
FIG. 21A is a side view illustrating a toner cartridge and a toner cartridge holding member for explaining a state of a seal member when the toner cartridge is slid in a mounting direction.
Figure 21B:
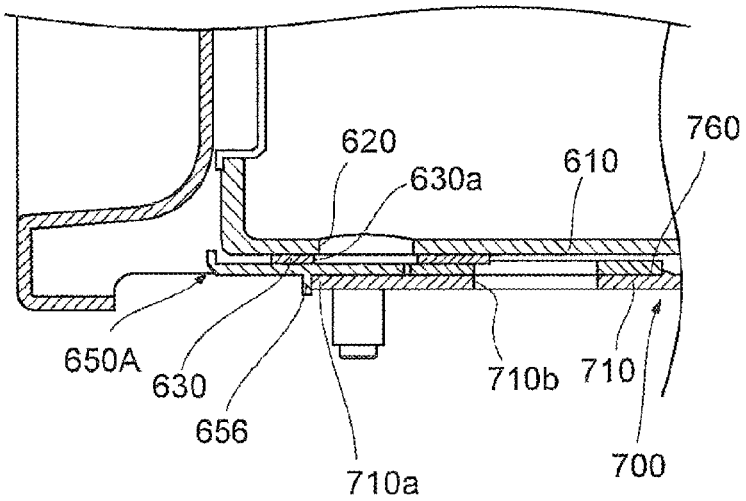
FIG. 21B is a cross-sectional view illustrating a periphery of the seal member for explaining a state of the seal member when the toner cartridge is slid in a mounting direction.

FIG. 21 illustrates a state in which the toner cartridge 600 is slid further in the mounting direction so that the seal member 630 and the holding member-side seal member 760 are more overlapped. Also, FIG. 21 illustrates a state in which the toner accommodating portion 610 is induced (or pulled) toward the supporting portion 710 of the toner cartridge holding member 700 so that portions of the seal member 630 and the holding member-side seal member 760 are pressed. FIG. 22 illustrates a state in which the toner cartridge 600 is slid further in the mounting direction so that the discharge port 620 is in communication with the opening 710*b*. Also, FIG. 22 illustrates a state in which the toner accommodating portion 610 is induced toward the supporting portion 710 of the toner cartridge holding member 700 so that the seal member 630 and the holding member-side seal member 760 are pressed.

As illustrated in FIGS. 19 to 22, according as the toner cartridge 600 is slid in the mounting direction with respect to the toner cartridge holding member 700, the seal member 630 and the holding member-side seal member 760 are overlapped. After the seal member 630 and the holding member-side seal member 760 are overlapped, if the toner cartridge 600 is slid further, the toner accommodating portion 610 is pulled toward the supporting portion 710. Thereby, as illustrated in FIG. 21, the seal member 630 and the holding member-side seal member 760 are pressed against each other. Then, if the toner cartridge 600 is slid further, as illustrated in FIG. 22, the discharge port 620 and the opening 710*b* are in communication with each other.

Figure 23:
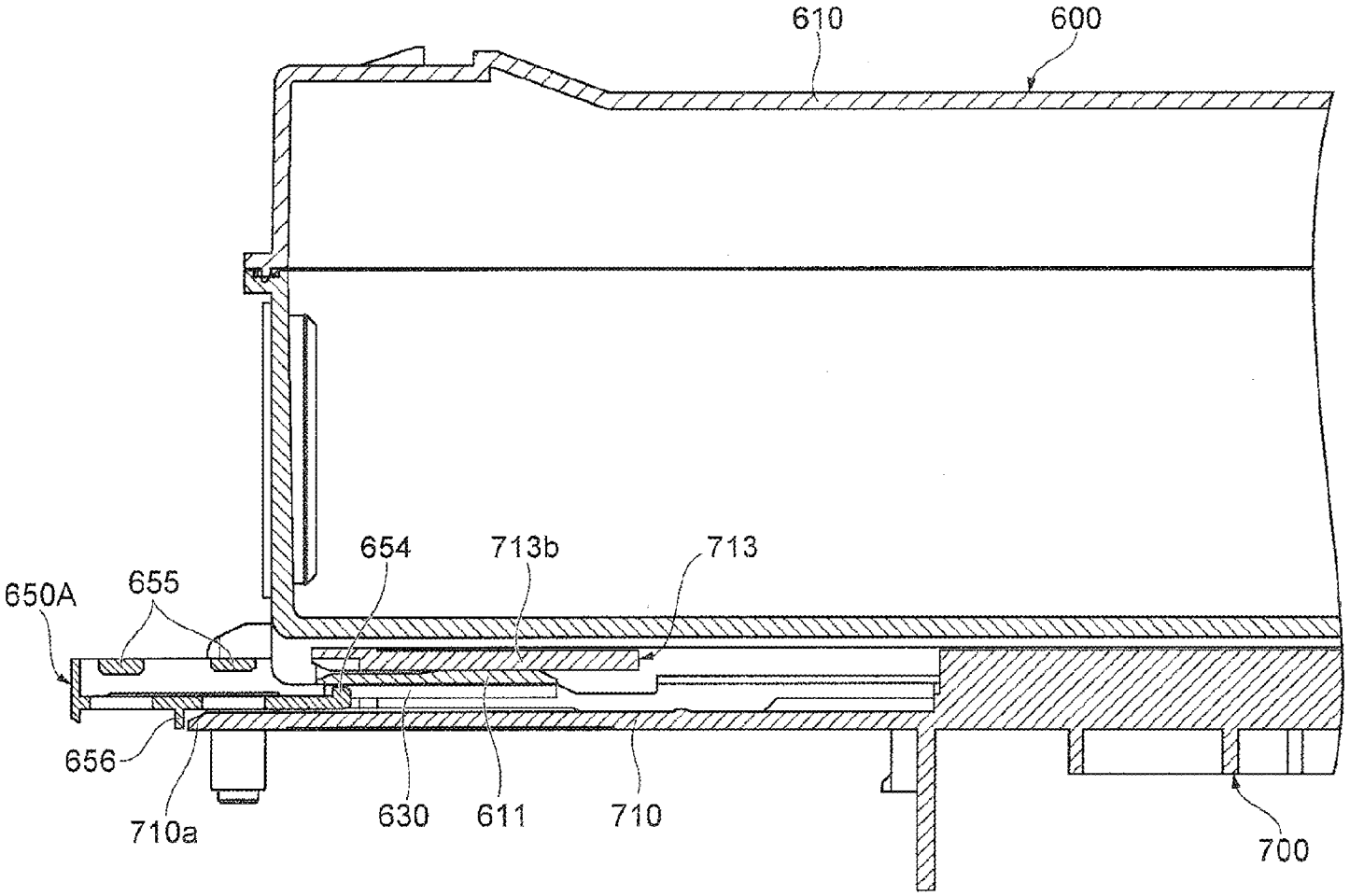
FIG. 23 is a cross-sectional view illustrating a state in which a toner accommodating portion is induced toward a supporting portion of a toner cartridge holding member.

Hereinafter, a configuration for inducing the toner accommodating portion 610 toward the supporting portion 710 of the toner cartridge holding member 700 will be described with reference to FIG. 23.

As described above, the holding coupling portions 713 of the toner cartridge holding member 700 are provided with the protrusions 713*b* to be coupled with the cartridge-side guide portions 611 of the toner cartridge 600. When the toner cartridge 600 is slid in the mounting direction, the protrusion 713*b* is coupled with the cartridge-side guide portion 611 in the sliding position of the toner accommodating portion 610 from when the seal member 630 and the holding member-side seal member 760 are overlapped to the toner supply position. Here, that the seal member 630 and the holding member-side seal member 760 are overlapped is that, when viewing in an axial direction of the discharge port 620 (a direction along the axial direction U in FIG. 25), the seal member 630 and the holding member-side coupling portions 711 overlap.

The protrusion 713*b* is coupled with the cartridge-side guide portions 611, thereby inducing the toner accommodating portion 610 to approach toward the supporting portion 710 of the toner cartridge holding member 700. In other words, when the cartridge-side guide portions 611 is slid so that the seal member 630 and the holding member-side seal member 760 are overlapped, the protrusion 713*b* pulls the toner accommodating portion 610 toward the supporting portion 710 of the toner cartridge holding member 700 more than when the seal member 630 and the holding member-side seal member 760 are not overlapped. Thus, the protrusion 713*b* functions as a pulling portion which induces the toner accommodating portion 610 toward the supporting portion 710 of the toner cartridge holding member 700.

Figure 24:
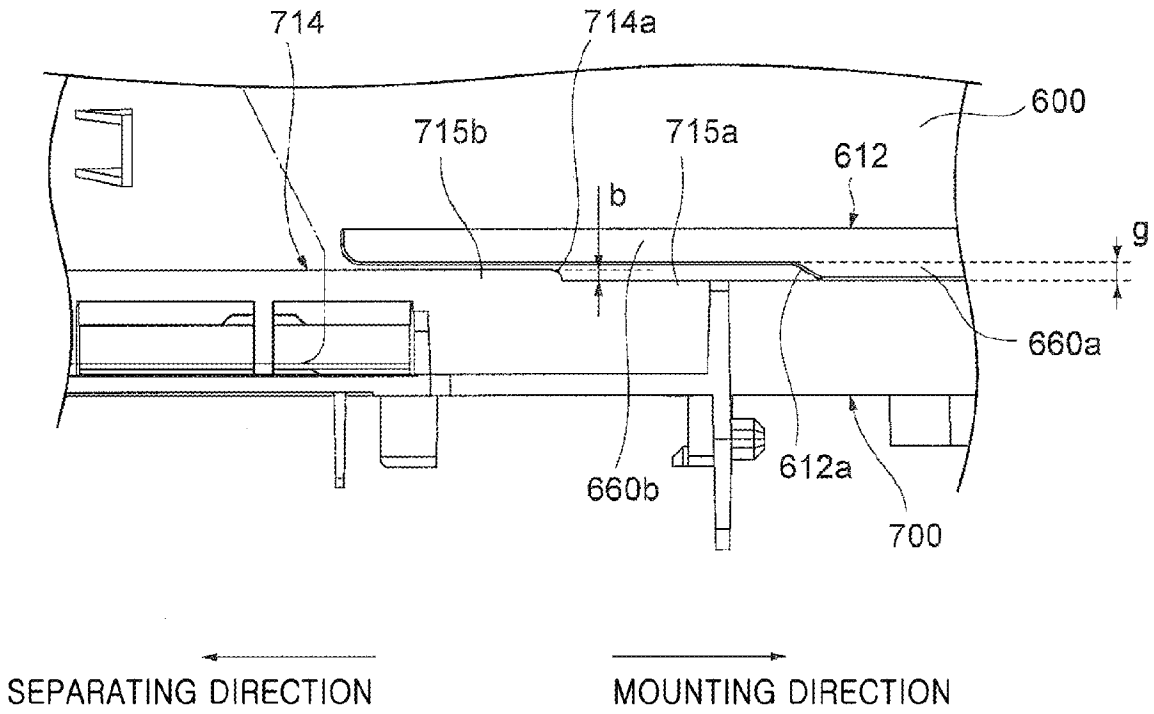
FIG. 24 is a side view illustrating a state in which a cartridge-side inducing portion and a holding member-side inducing portion are in contact with each other.

Next, a relationship of the cartridge-side inducing portions (slide guides) 612 provided in the toner cartridge 600 and the holding member-side inducing portions 714 provided in the toner cartridge holding member 700 will be described with reference to FIG. 24.

The cartridge-side inducing portion 612 includes a first guide portion 660*a* and a second guide portion 660*b*. The second guide portion 660*b* is placed on the side of the separating direction of the toner cartridge 600 than the first guide portion 660*a*. The first guide portion 660*a* protrudes toward the holding member-side inducing portions 714 than the second guide portion 660*b* in the state in which the toner cartridge 600 is mounted to the toner cartridge holding member 700.

The holding member-side inducing portion 714 includes a third guide portion 715*a* and a fourth guide portion 715*b*. The fourth guide portion 715*b* is placed on the side of the separating direction of the cartridge than the third guide portion 715*a*. The fourth guide portion 715*b* protrudes toward the cartridge-side inducing portions 612 than the third guide portion 715*a* in the state in which the toner cartridge 600 is mounted to the toner cartridge holding member 700.

Here, a height to which the first guide portion 660*a* projects from the second guide portion 660*b* is referred to as a protrusion height g. A height to which the fourth guide portion 715*b* projects from the third guide portion 715*a* and to which the holding member-side inducing portions 714 induce the toner cartridge 600 is referred to as an induced height b. The induced height b and the protrusion height g satisfy the relationship of b≤g. By satisfying the relationship, in the state in which the toner cartridge 600 is mounted to the toner cartridge holding member 700 and the discharge port 620 is in communication with the opening 710*b*, the first guide portion 660*a* is in contact with the third guide portion 715*a*.

Hereinafter, when the coupling between the shutter-side coupling portions 653 and the holding member-side coupling portions 711 is released, a configuration in which the shutter 650A is rotated will be described with reference to FIGS. 25 and 26. As described in the above embodiment, the slide coupling portions 655 of the shutter 650A are coupled with the cartridge-side guide portions 611 by the toner accommodating portion 610 being slid in the separating direction. Thus, in the state in which the slide coupling portions 655 are coupled with the cartridge-side guide portions 611, the shutter 650A covers the discharge port 620. The shutter 650A covers the discharge port 620 in a state in which the seal member 630 is interposed between the shutter 650A and the toner accommodating portion 610 (see FIG. 25).

Here, as described in the above embodiment, if the toner accommodating portion 610 is slid further after the discharge port 620 is closed, the shutter-side coupling portions 653 climb up the holding member-side coupling portions 711. The coupling between the shutter-side coupling portions 653 and the holding member-side coupling portions 711 is released by the shutter-side coupling portions 653 climbing up the holding member-side coupling portions 711. Also, as illustrated in FIG. 26, in a state where the cartridge-side guide portions 611 is sandwiched between the slide coupling portions 655 and the shutter body 651, the coupling between the shutter-side coupling portions 653 and the holding member-side coupling portions 711 is released.

Here, a sliding position of the toner accommodating portion 610 when the coupling between the shutter-side coupling portions 653 and the holding member-side coupling portions 711 is released is referred to as a first sliding position. Also, a state when the coupling between the shutter-side coupling portions 653 and the holding member-side coupling portions 711 is released includes, as illustrated in FIGS. 25 and 26, a state in which the shutter-side coupling portions 653 is climbing the holding member-side coupling portions 711 and a state in which the shutter-side coupling portions 653 starts to climb the holding member-side coupling portions 711 in addition to when the coupling is released (the released moment). A direction that is perpendicular to the separating direction of the toner cartridge 600 and is at the same time perpendicular to the direction of the axial line U of the discharge port 620 is referred to as a first direction (a direction indicated as arrow B in FIG. 17). When the toner accommodating portion 610 is placed in the first sliding position, the discharge port 620 is, when viewing in the first direction, placed between one end and the other end of the slide coupling portions 655 in the separating direction of the toner cartridge 600.

In this embodiment, as illustrated in FIG. 16, the one side-wall 652 is provided with two slide coupling portions 655, and the other side-wall 652 is provided with two slide coupling portions 655. Also, the two slide coupling portions 655 disposed on the one side-wall 652, as illustrated in FIG. 25, when viewing in the first direction, are spaced apart from each other by a predetermined interval in the separating direction of the toner cartridge 600. Also, for convenience of explanation, as illustrated in FIG. 25, the slide coupling portion 655, which is on the side of the separating direction of the toner cartridge 600, of the slide coupling portions 655 provided along the separating direction of the toner cartridge 600 is referred to as a slide coupling portions 655*a*. The slide coupling portion 655, which is on the side of the mounting direction of the toner cartridge 600, is referred to as a slide coupling portion 655*b*.

Figure 25:
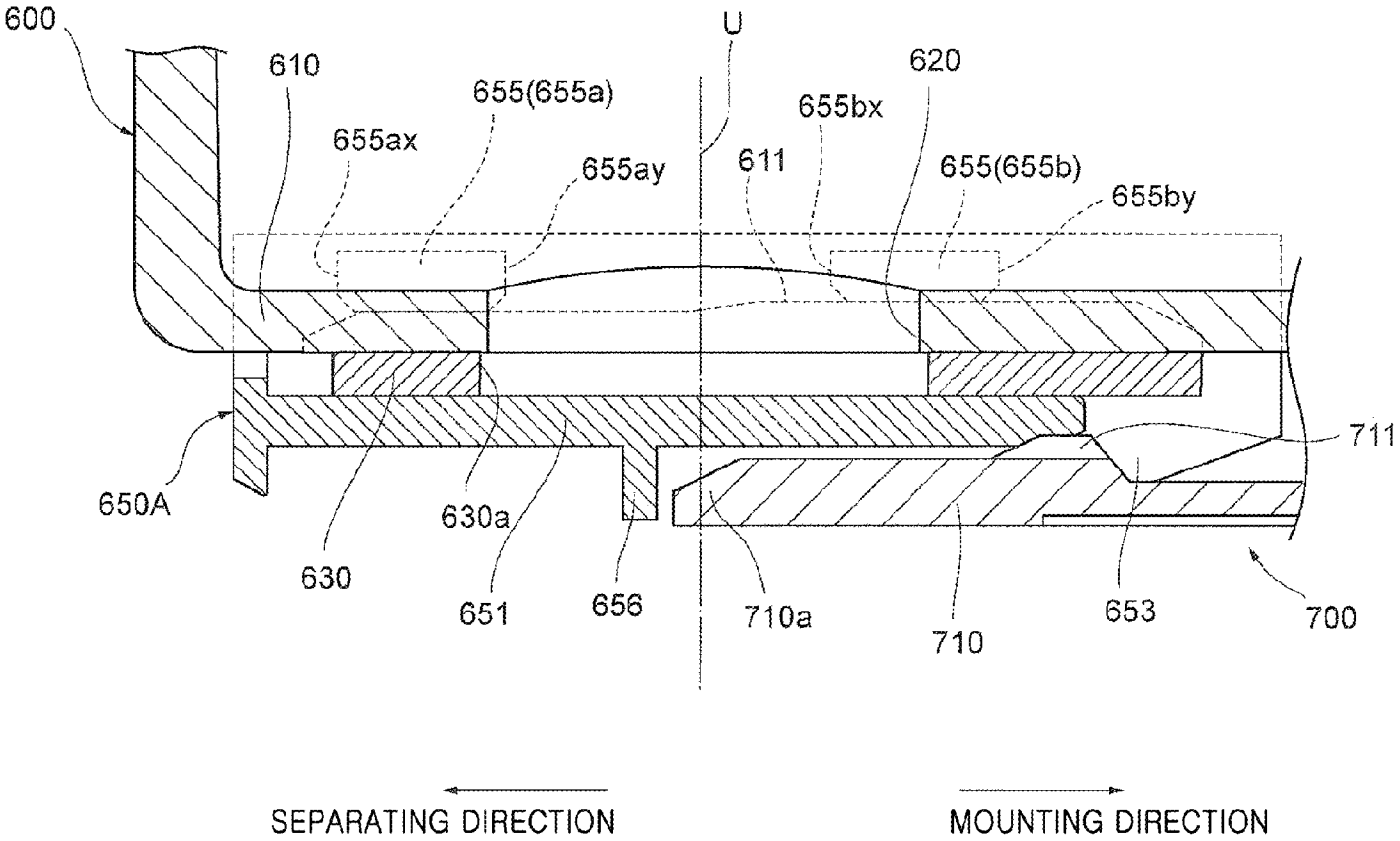
FIG. 25 is a cross-sectional view illustrating a state of a shutter when coupling between a shutter-side coupling portion and a holding member-side coupling portion is released.
Figure 26:
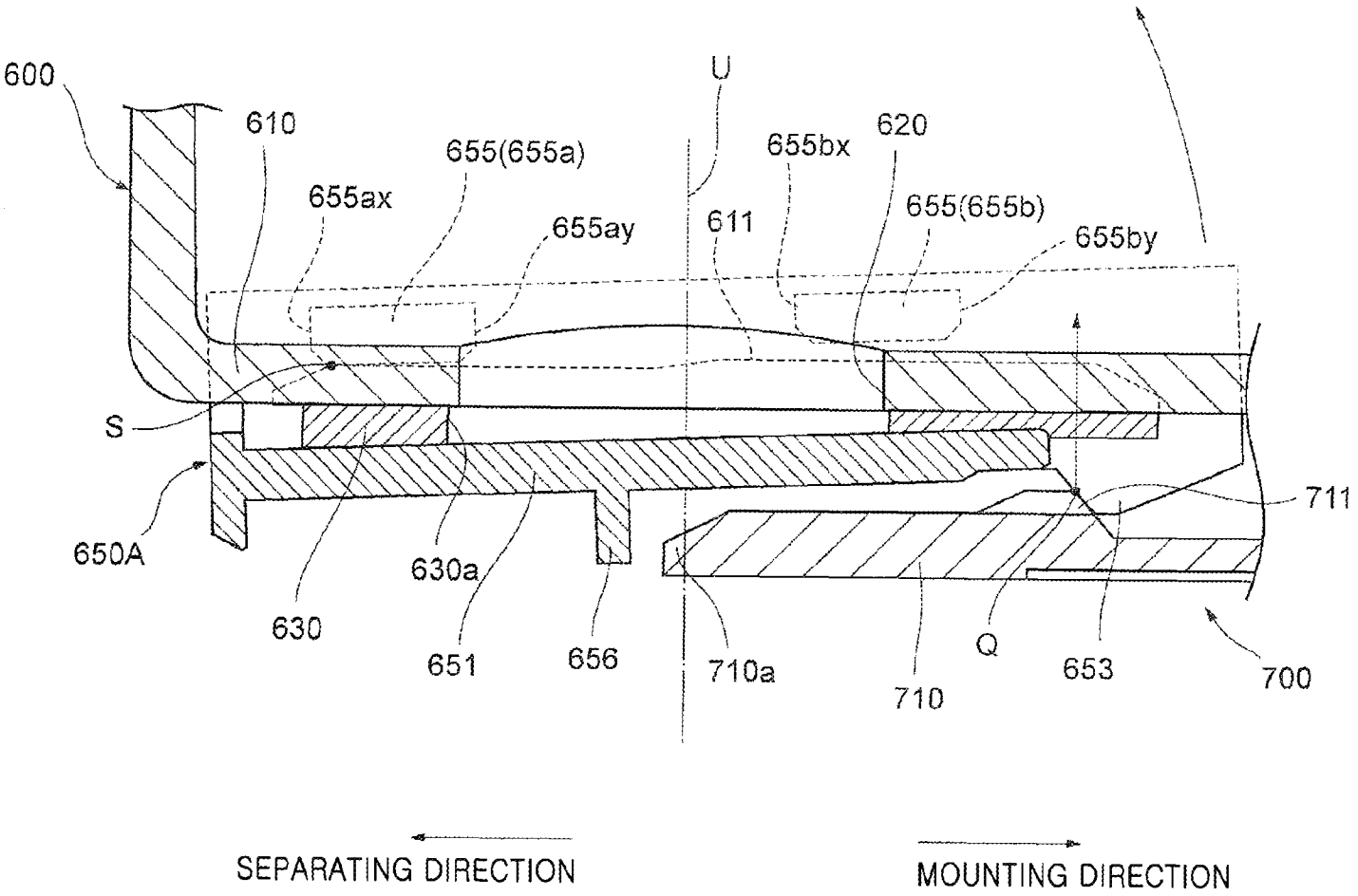
FIG. 26 is a cross-sectional view illustrating a rotational state of a shutter when coupling between a shutter-side coupling portion and a holding member-side coupling portion is released.

As illustrated in FIGS. 25 and 26, the opposite ends of the slide coupling portions 655*a* along the separating direction of the toner cartridge 600 are referred to as an end 655*ax* and an end 655*ay*. The end 655*ax* is located on the side of the separating direction of the toner cartridge 600 more than the end 655*ay*. The opposite ends of the slide coupling portions 655*b* along the separating direction of the toner cartridge 600 are referred to as an end 655*bx* and an end 655*by*. The end 655*bx* is located on the side of the separating direction of the toner cartridge 600 more than the end 655*by*.

In the present embodiment, when the toner accommodating portion 610 is located in the first sliding position, the discharge port 620 is, when viewing in the first direction, located between the end 655*ax* of the slide coupling portion 655*a* and the end 655*by* of the slide coupling portion 655*b*. In this way, when a plurality of slide coupling portions 655 is disposed along the sliding direction of the toner cartridge 600, the discharge port 620 may be located between the outermost ends in the sliding direction.

Figure 27:
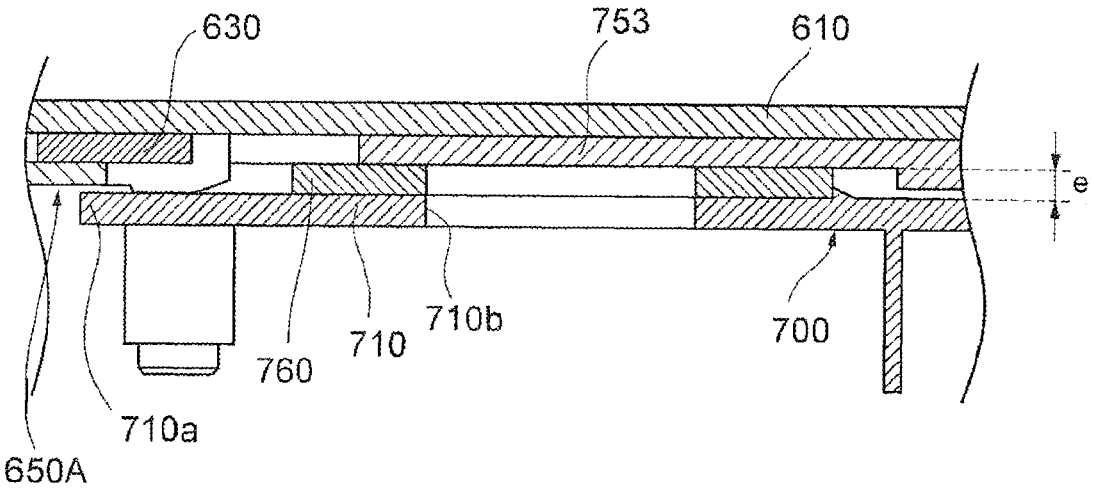
FIG. 27 is a cross-sectional view illustrating a state in which an opening is closed by a holding member-side shutter.

As illustrated in FIG. 27, when the discharge port 620 is not in communication with the opening 710*b*, the opening 710*b* is closed by the holding member-side shutter 753. The holding member-side shutter 753 closes the opening 710*b* in a state in which the holding member-side seal member 760 is interposed between the holding member-side shutter 753 and the supporting portion 710 in which the opening 710*b* is formed. The holding member-side shutter 753 is disposed to slide with respect to the supporting portion 710. When the toner accommodating portion 610 is slid in the separating direction, the holding member-side shutter 753 is coupled with the toner accommodating portion 610, thereby being slid along with the toner accommodating portion 610. Thereby, the opening 710*b* is closed by the holding member-side shutter 753. Also, when the toner accommodating portion 610 is slid in the mounting direction, the holding member-side shutter 753 is coupled with the toner accommodating portion 610, and thus is slid along with the toner accommodating portion 610, thereby opening the opening 710*b*. In other words, the holding member-side shutter 753 closes or opens the opening 710*b* by being slid on the top surface of the holding member-side seal member 760.

When the discharge port 620 is not in communication with the opening 710*b* and the opening 710*b* is closed by the holding member-side shutter 753, a thickness of the holding member-side seal member 760 is referred to as a thickness e. Here, as illustrated in FIG. 22, when the toner accommodating portion 610 is located in the toner supply position, the thickness of the holding member-side seal member 760 is referred to as a thickness d. In other words, when the holding member-side seal member 760 is pressed by the seal member 630, the thickness of the holding member-side seal member 760 is referred to as the thickness d. At this time, the thickness e and the thickness d satisfy the relationship of d≤e. In detail, the slide height of the holding member-side shutter 753 with respect to the supporting portion 710, or an induced amount by which the protrusion 713*b* induces the toner accommodating portion 610 toward the supporting portion 710 is set to satisfy the above relationship.

The toner supply apparatus 60 according to the present embodiment exerts the following operational effects in addition to the operational effects of the above-described embodiment by the configuration as described above. In other words, as described with reference to FIGS. 22 and 27, when the toner accommodating portion 610 is located in the toner supply position, the thickness of the holding member-side seal member 760 is referred to as the thickness d. When the discharge port 620 is not in communication with the opening 710*b*, the thickness of the holding member-side seal member 760 when the holding member-side seal member 760 is interposed therebetween by the holding member-side shutter 753 is referred to as a thickness e. At this time, the thickness e and the thickness d satisfy the relationship of d≤e. In other words, a height of the top surface of the holding member-side seal member 760 when the opening 710*b* is closed by the holding member-side shutter 753 is higher than when the discharge port 620 is in communication with the opening 710*b* (when d=e, they are in the same level). Here, when the discharge port 620 is not in communication with the opening 710*b*, the supply of toner is stopped. Accordingly, when the discharge port 620 is not in communication with the opening 710*b*, the height of the top surface of the holding member-side seal member 760 is higher than the height of a top surface of the toner which faces the opening 710*b* (when d=e, they are in the same level). When closing the opening 710*b*, the holding member-side shutter 753 is slid on the top surface of the holding member-side seal member 760 which is at a position higher than or the same height as the tope surface of the toner which faces the opening 710*b*. Thereby, the holding member-side shutter 753 may be prevented from scratching the toner facing the opening 710*b*. Accordingly, toner may be prevented from being scattered through the opening 710*b*, and the inside of the toner supply apparatus 60 may be prevented from being contaminated by the toner.

As described with reference to FIG. 23, the protrusion 713*b* of the toner cartridge holding member 700 is coupled with the cartridge-side guide portions 611 when the toner cartridge 600 is slid in the mounting direction. Then, the protrusion 713*b* induces the toner accommodating portion 610 to approach toward the supporting portion 710. The degree of closeness of the seal member 630 and the holding member-side seal member 760 is increased by that the toner accommodating portion 610 is induced by the protrusion 713*b*. Thereby, the toner may be reliably prevented from leaking from the contact portion of the seal member 630 and the holding member-side seal member 760. Also, when viewing along the direction of the axial line of the discharge port 620, after the seal member 630 and the holding member-side seal member 760 are overlapped, the seal member 630 is brought into close contact with the holding member-side seal member 760 by the protrusion 713*b*. Thereby, when sliding the toner accommodating portion 610, it may be prevented that the end of the seal member 630 and the end of the holding member-side seal member 760 is caught in each other. Accordingly, damage of the end of the seal member 630 and the end of the holding member-side seal member 760 may be prevented.

As described with reference to FIGS. 25 and 26, when the toner accommodating portion 610 is located at the first slide position, the discharge port 620, when viewing in the first direction, is placed between the end 655*ax* of the slide coupling portion 655*a* and the end 655*by* of the slide coupling portion 655*b*. Here, by sliding the toner accommodating portion 610 in the separating direction, the discharge port 620 is closed by the shutter 650A. After the discharge port 620 is closed, the coupling between the shutter-side coupling portions 653 and the holding member-side coupling portions 711 is released by the shutter-side coupling portions 653 climbing up the holding member-side coupling portions 711. When the shutter-side coupling portions 653 climb over the holding member-side coupling portions 711, as illustrated in FIG. 26, a point where the shutter-side coupling portions 653 and the holding member-side coupling portions 711 are coupled with each other acts as a force point Q. Thereby, the shutter 650A is pushed toward the toner accommodating portion 610 to press the seal member 630. Also, as illustrated in FIG. 26, when the shutter-side coupling portions 653 climb over the holding member-side coupling portions 711, one, which is located on the far side from the force point Q, of the end 655*ax* of the slide coupling portion 655*a* and the end 655*by* of the slide coupling portion 655*b* acts as a fulcrum S. In other words, when viewing in the first direction, the shutter 650A is rotated about the fulcrum S so that the end of the shutter 650A, in which the shutter-side coupling portions 653 are coupled with the holding member-side coupling portions 711, approaches toward the toner accommodating portion 610. Also, the discharge port 620, when viewing in the first direction, is placed between the end 655*ax* of the slide coupling portion 655*a* and the end 655*by* of the slide coupling portion 655*b*. In other words, when the shutter 650A is rotated, the fulcrum S is, when viewing in the first direction, located at the outside of the discharge port 620. Thereby, when the shutter 650A is rotated around the fulcrum S so that the seal member 630 is pressed, excessive deformation of the seal member 630 may be prevented. Also, in the peripheral edge of the discharge port 620, the seal member 630 may be uniformly pressed by the shutter body 651 of the shutter 650A. Accordingly, the toner may be prevented from leaking from a gap between the seal member 630 and the shutter body 651 of the shutter 650A.

As described with reference to FIG. 15, in the position where the shutter 650A closes the discharge port 620, the sliding operation of the shutter 650A is restricted by the action restricting portions 658. Accordingly, the shutter 650A is prevented from being slid by an unexpected load in a position where the shutter 650A closes the discharge port 620. Thereby, it is possible to suppress the leakage of the toner from the toner accommodating portion 610.

As described with reference to FIGS. 17, 18A, and 18B, when the toner accommodating portion 610 is slid in the mounting direction so that the end portion 710*a* of the supporting portion 710 is in contact with the shutter 650A, the restriction releasing portions 718 releases the restriction of the sliding operation of the shutter 650A by the action restricting portions 658. In this way, only when the end portion 710*a* is in contact with the bottom-side projection 656 of the shutter 650A to open the shutter 650A, the restriction of the sliding operation of the shutter 650A by the action restricting portions 658 is released. Accordingly, when unexpected, the toner may be prevented from leaking from the discharge port 620.

When the toner accommodating portion 610 is slid in the separating direction, and the coupling between the shutter-side coupling portions 653 and the holding member-side coupling portions 711 is released, the restriction releasing portions 718 allows the action restricting portions 658 to restrict the sliding operation of the shutter 650A. In this way, when separating the toner cartridge 600, after the discharge port 620 is closed by the shutter 650A, the sliding operation of the shutter 650A is restricted. Accordingly, it does not occur that the shutter 650A is slid by an unexpected load so that the discharge port 620 is opened. Thereby, the toner may be prevented from leaking from the discharge port 620.

As described with reference to FIG. 24, in the state in which the toner cartridge 600 is mounted to the toner cartridge holding member 700, the first guide portion 660*a* is in contact with the third guide portion 715*a*. Thereby, the position of the toner cartridge 600 relative to the toner cartridge holding member 700 is defined. In this state, by satisfying the above-described relationship of b≤g, the second guide portion 660*b* and the fourth guide portion 715*b* do not interfere. Accordingly, in the state in which the toner cartridge 600 is mounted to the toner cartridge holding member 700, it is possible to reliably define the position of the toner cartridge 600 by the first guide portion 660*a* and the third guide portion 715*a*. Since the position of the toner cartridge 600 is stable as described above, the toner may be prevented from leaking from the portion in which the toner accommodating portion 610 and the toner cartridge holding member 700 are in communication with each other.

As described above, an embodiment of the present disclosure has been described, but the present disclosure is not limited to the above embodiment. For example, the tandem type of image forming apparatus 1 as illustrated in FIG. 1 is one example of the image forming apparatus using the toner supply apparatus 60 and the toner cartridge 600 according to the present embodiment. The toner supply apparatus 60 and the toner cartridge 600 according to an embodiment of the present disclosure can be applied to many different types of image forming apparatuses. Also, the toner supply apparatus 60 and the toner cartridge 600 according to the this embodiment may be used in an image forming apparatus for monochrome print, not the image forming apparatus 1 capable of color printing.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A toner supply apparatus which comprises a toner cartridge, having a toner accommodating portion and a shutter to close a discharge port of toner disposed in the toner accommodating portion, and a toner cartridge holding member from which the toner cartridge is separated by sliding the toner cartridge, the toner supply apparatus comprising:

the shutter comprising shutter-side coupling portions projecting toward the toner cartridge holding member, the toner cartridge holding member comprising:

holding member-side coupling portions to allow the shutter to slide with respect to the toner accommodating portion to close the discharge port by being coupled with the shutter-side coupling portions when the toner accommodating portion is slid in a separating direction of the toner cartridge;

a toner cartridge position restricting portion to restrict movement of the toner cartridge in a direction in which coupling between the shutter-side coupling portions and the holding member-side coupling portions is released in a sliding position of the toner accommodating portion until the toner accommodating portion is slid in the separating direction of the toner cartridge so that the discharge port is closed by the shutter; and an inducing portion to induce the toner cartridge in a direction in which the coupling between the shutter-side coupling portions and the holding member-side coupling portions is released in a sliding position of the toner accommodating portion after the toner accommodating portion is slid in the separating direction of the toner cartridge so that the discharge port is closed by the shutter, and the toner accommodating portion comprising a shutter position restricting portion to restrict movement of the shutter in a direction in which the coupling between the shutter-side coupling portions and the holding member-side coupling portions is released in the sliding position of the toner accommodating portion until the toner accommodating portion is slid in the separating direction of the toner cartridge so that the discharge port is closed by the shutter.

2. The toner supply apparatus of claim 1, wherein a coupled height a of the shutter-side coupling portion and the holding member-side coupling portion and an induced height b to which the inducing portion induces the toner cartridge satisfy a relationship of a≤b.

3. The toner supply apparatus of claim 1, wherein the shutter is configured to be moved with respect to the toner accommodating portion from a closed position of the discharge port in a direction in which the coupling between the shutter-side coupling portions and the holding member-side coupling portions is released.

4. The toner supply apparatus of claim 3, wherein a coupled height a of the shutter-side coupling portion and the holding member-side coupling portion, an induced height b to which the inducing portion induces the toner cartridge, and a moving height c by which the shutter is configured to move in the closed position of the discharge port satisfy a relationship of a−b≤c, where c≠0.

5. The toner supply apparatus of claim 1, wherein a main body portion of the toner cartridge holding member comprises a toner supply port which is in communication with the discharge port when the toner cartridge is mounted to the toner cartridge holding member and the toner accommodating portion is placed in a toner supply position where the toner is supplied from the toner accommodating portion toward the toner cartridge holding member, the toner cartridge holding member further comprises a holding member-side seal member which surrounds a periphery of the toner supply port, and seals a gap between the toner accommodating portion and the main body portion of the toner cartridge holding member when the toner accommodating portion is placed in the toner supply position, and a holding member-side shutter which closes the toner supply port by allowing the holding member-side seal member to be interposed between the main body portion of the toner cartridge holding member and the toner supply port when the discharge port is not in communication with the toner supply port, the holding member-side seal member is formed of an elastic material, and a thickness d of the holding member-side seal member when the toner accommodating portion is located at the toner supply position and a thickness e of the holding member-side seal member when the discharge port is not in communication with the toner supply port and the holding member-side seal member is interposed therebetween by the holding member-side shutter satisfy a relationship of d≤e.

6. The toner supply apparatus of claim 5, wherein the toner cartridge further comprises a cartridge-side seal member which surrounds the periphery of the discharge port and is formed of an elastic material, and the toner cartridge holding member further comprises a pulling portion which induces the toner accommodating portion to approach toward the main body portion of the toner cartridge holding member in a sliding position of the toner accommodating portion from when the cartridge seal member and the holding member-side seal member are overlapped to the toner supply position, when viewing in a direction of an axial line of the discharge port, while the toner accommodating portion is slid in a mounting direction opposite to the separating direction of the toner cartridge than when the toner cartridge seal member and the holding member-side seal member are not overlapped.

7. The toner supply apparatus of claim 6, wherein the cartridge seal member surrounds a periphery of the discharge port and seals a gap between the toner accommodating portion and the shutter when the discharge port is closed by the shutter, the shutter comprises slide coupling portions to be coupled with the toner accommodating portion in a sliding position of the toner accommodating portion when the toner accommodating portion is slid in the separating direction of the toner cartridge so that the coupling between the shutter-side coupling portions and the holding member-side coupling portions is released, and if the sliding position of the toner accommodating portion when the coupling between the shutter-side coupling portions and the holding member-side coupling portions is released is referred to as a first sliding position, and a direction which is perpendicular to the separating direction of the toner cartridge and at the same time perpendicular to the direction of the axial line of the discharge port is referred to as a first direction, when the toner accommodating portion is placed at the first sliding position, the discharge port, when viewing in the first direction, is placed between one end and the other end of the slide coupling portions along the separating direction of the toner cartridge.

8. The toner supply apparatus of claim 1, wherein the toner cartridge further comprises a cartridge-side seal member which surrounds the periphery of the discharge port and seals a gap between the toner accommodating portion and the shutter when the discharge port is closed by the shutter, the cartridge-side seal member is formed of an elastic material, the shutter comprises slide coupling portions to be coupled with the toner accommodating portion in a sliding position of the toner accommodating portion when the toner accommodating portion is slid in the separating direction of the toner cartridge so that the coupling between the shutter-side coupling portions and the holding member-side coupling portions is released, and if the sliding position of the toner accommodating portion when the coupling between the shutter-side coupling portions and the holding member-side coupling portions is released is referred to as a first sliding position, and a direction which is perpendicular to the separating direction of the toner cartridge and at the same time perpendicular to the distance of the axial line of the discharge port is referred to as a first direction, when the toner accommodating portion is placed at the first sliding position, the discharge port, when viewing in the first direction, is placed between one end and the other end of the slide coupling portion along the separating direction of the toner cartridge.

9. The toner supply apparatus of claim 1, wherein the shutter comprises action restricting portions to restrict the sliding operation of the shutter with respect to the toner accommodating portion in a position where the shutter closes the discharge port.

10. The toner supply apparatus of claim 9, wherein the toner cartridge holding member further comprises holding member-side shutter coupling portions which are coupled with the shutter to slide the shutter with respect to the toner accommodating portion in a direction in which the discharge port is opened when the toner accommodating portion is slid in a mounting direction opposite to the separating direction of the toner cartridge; and restriction releasing portions which release the restriction of the sliding operation of the shutter by the action restricting portions when the toner cartridge is slid in the mounting direction so that the holding member-side shutter coupling portions are coupled with the shutter.

11. The toner supply apparatus of claim 10, wherein, when the toner accommodating portion is slid in the separating direction of the toner cartridge so that the coupling between the shutter-side coupling portions and the holding member-side coupling portions is released, the restriction releasing portions allow the action restricting portions to restrict the sliding operation of the shutter.

12. The toner supply apparatus of claim 1, wherein the toner cartridge further comprises a slide guide extending along a sliding direction of the toner cartridge, the inducing portion is slidably in contact with the slide guide when mounting and separating the toner cartridge, the slide guide includes a first guide portion and a second guide portion, the second guide portion is located on a side of the separating direction of the toner cartridge than the first guide portion, the first guide portion projects toward the inducing portion than the second guide portion in a state where the toner cartridge is mounted to the toner cartridge holding member, the inducing portion includes a third guide portion and a fourth guide portion, the fourth guide portion is located on a side of the separating direction of the toner cartridge than the third guide portion, the fourth guide portion projects toward the slide guide than the third guide portion in a state where the toner cartridge is mounted to the toner cartridge holding member, and an induced height b to which the inducing portion induces the toner cartridge and which is a height to which the fourth guide portion projects from the third guide portion, and a protrusion height g to which the first guide portion projects from the second guide portion satisfy a relationship of b≤g.

13. The toner supply apparatus of claim 1, wherein the toner cartridge further comprises a cartridge-side seal member which surrounds the periphery of the discharge port and is formed of an elastic material, a main body portion of the toner cartridge holding member comprises a toner supply port which is in communication with the discharge port when the toner cartridge is mounted to the toner cartridge holding member and the toner accommodating portion is placed in a toner supply position where the toner is supplied from the toner accommodating portion toward the toner cartridge holding member, and the toner cartridge holding member further comprises a holding member-side seal member which surrounds a periphery of the toner supply opening, and is formed of an elastic material; and a pulling portion which induces the toner accommodating portion to approach toward the body portion of the toner cartridge holding member in a sliding position of the toner accommodating portion from when the cartridge seal member and the holding member-side seal member are overlapped to the toner supply position, when viewing in a direction of an axial line of the discharge port, while the toner accommodating portion is slid in a mounting direction opposite to the separating direction of the toner cartridge than when the toner cartridge seal member and the holding member-side seal member are not overlapped.

14. A toner cartridge which comprises a toner accommodating portion and a shutter to close a discharge port of toner disposed in the toner accommodating portion, and is separated from a toner cartridge holding member by sliding, the toner cartridge comprising:

shutter-side coupling portions which are disposed in the shutter, and are, when the toner accommodating portion is slid in a separating direction, coupled with holding member-side coupling portions of the toner cartridge holding member to slide the shutter with respect to the toner accommodating portion, thereby closing the discharge port, and a shutter position restricting portion which is disposed in the toner accommodating portion, and restricts movement of the shutter in a direction in which coupling between the shutter-side coupling portions and the holding member-side coupling portions is released in a sliding position of the toner accommodating portion until the toner accommodating portion is slid in the separating direction so that the discharge port is closed by the shutter.

15. The toner cartridge of claim 14, wherein the shutter comprises an action restricting portion to restrict a sliding operation of the shutter with respect to the toner accommodating portion in a position where the shutter closes the discharge port.

16. An image forming apparatus comprising:

a plurality of photosensitive drums positioned to receive toner from a plurality of developing units and to apply toner to a transfer belt; and a plurality of toner supply apparatuses which supply toner to the developing units, wherein each toner supply apparatus comprises:

a toner cartridge having a toner accommodating portion and a shutter which comprises shutter-side projections, and a toner cartridge holding member comprising:

holding member-side coupling portions to allow the shutter to slide with respect to the toner accommodating portion to close the discharge port by being coupled with the shutter-side coupling portions when the toner accommodating portion is slid in a separating direction of the toner cartridge;

a toner cartridge position restricting portion to restrict movement of the toner cartridge in a direction in which coupling between the shutter-side coupling portions and the holding member-side coupling portions is released in a sliding position of the toner accommodating portion until the toner accommodating portion is slid in the separating direction of the toner cartridge so that the discharge port is closed by the shutter; and an inducing portion to induce the toner cartridge in a direction in which the coupling between the shutter-side coupling portions and the holding member-side coupling portions is released in a sliding position of the toner accommodating portion after the toner accommodating portion is slid in the separating direction of the toner cartridge so that the discharge port is closed by the shutter, wherein the toner accommodating portion comprising a shutter position restricting portion to restrict movement of the shutter in a direction in which the coupling between the shutter-side coupling portions and the holding member-side coupling portions is released in the sliding position of the toner accommodating portion until the toner accommodating portion is slid in the separating direction of the toner cartridge so that the discharge port is closed by the shutter.

17. An image forming apparatus comprising:

a plurality of photosensitive drums positioned to receive toner from a plurality of developing units and to apply toner to a transfer belt; and a plurality of toner cartridges which supply toner to the developing units, wherein each toner cartridge comprises:

a toner accommodating portion, a shutter to close a discharge port of toner disposed in the toner accommodation portion, shutter-side coupling portions which are disposed in the shutter, and are, when the toner accommodating portion is slid in a separating direction, coupled with holding member-side coupling portions of the toner cartridge holding member to slide the shutter with respect to the toner accommodating portion, thereby closing the discharge port, and a shutter position restricting portion which is disposed in the toner accommodating portion, and restricts movement of the shutter in a direction in which coupling between the shutter-side coupling portions and the holding member-side coupling portions is released in a sliding position of the toner accommodating portion until the toner accommodating portion is slid in the separating direction so that the discharge port is closed by the shutter.

18. The image forming apparatus of claim 17, wherein the shutter comprises an action restricting portion to restrict a sliding operation of the shutter with respect to the toner accommodating portion in a position where the shutter closes the discharge port.

* * * * *